US011191328B2

(12) United States Patent
Disinger

(10) Patent No.: US 11,191,328 B2
(45) Date of Patent: Dec. 7, 2021

(54) LIGHT-EMITTING JEWELRY

(71) Applicant: NG DEVELOPMENTS, LLC, Huntingburg, IN (US)

(72) Inventor: John W. Disinger, Santa Claus, IN (US)

(73) Assignee: NG Developments, LLC, Huntingburg, IN (US)

( * ) Notice: Subject to any disclaimer, the term of this patent is extended or adjusted under 35 U.S.C. 154(b) by 0 days.

(21) Appl. No.: 16/639,165

(22) PCT Filed: Aug. 16, 2018

(86) PCT No.: PCT/US2018/000249
§ 371 (c)(1),
(2) Date: Feb. 14, 2020

(87) PCT Pub. No.: WO2019/035974
PCT Pub. Date: Feb. 21, 2019

(65) Prior Publication Data

US 2020/0170359 A1 Jun. 4, 2020

Related U.S. Application Data

(60) Provisional application No. 62/546,293, filed on Aug. 16, 2017.

(51) Int. Cl.
*A44C 15/00* (2006.01)
*A44C 17/00* (2006.01)
*A44C 17/04* (2006.01)

(52) U.S. Cl.
CPC ..... *A44C 15/0015* (2013.01); *A44C 17/04* (2013.01)

(58) Field of Classification Search
CPC ..... A44C 15/0015; A44C 17/04; A44C 17/02
USPC ..... 362/104
See application file for complete search history.

(56) References Cited

U.S. PATENT DOCUMENTS

| | | | |
|---|---|---|---|
| 165,722 | A | 7/1875 | Fry |
| 484,934 | A | 10/1892 | Jacobson |
| 634,567 | A | 10/1899 | Ballou et al. |
| 837,615 | A | 12/1906 | Dover |
| 1,064,152 | A | 6/1913 | Meyer |
| 1,204,915 | A | 11/1916 | Whitehouse |
| 1,211,240 | A | 1/1917 | Ryan |
| 1,293,028 | A | 2/1919 | Campbell |

(Continued)

FOREIGN PATENT DOCUMENTS

| | | |
|---|---|---|
| CN | 102754975 | 10/2012 |
| EP | 2179672 | 4/2012 |

(Continued)

OTHER PUBLICATIONS

European Search Report for European App. No. 17156176.4, sent Jun. 26, 2017, BD-104 EP || (62279-261955), 8 pages.

(Continued)

*Primary Examiner* — Jack W Lavinder
(74) *Attorney, Agent, or Firm* — Dentons Bingham Greenebaum LLP; Brian W. Chellgren

(57) ABSTRACT

A light-emitting jewelry piece includes a gemstone, a head, and a mounting. The head is configured to interconnect the gemstone to the mounting. The mounting is arranged to secure the light-emitting jewelry piece to a person or a personal adornment.

12 Claims, 23 Drawing Sheets

(56) References Cited

U.S. PATENT DOCUMENTS

Figure 1:
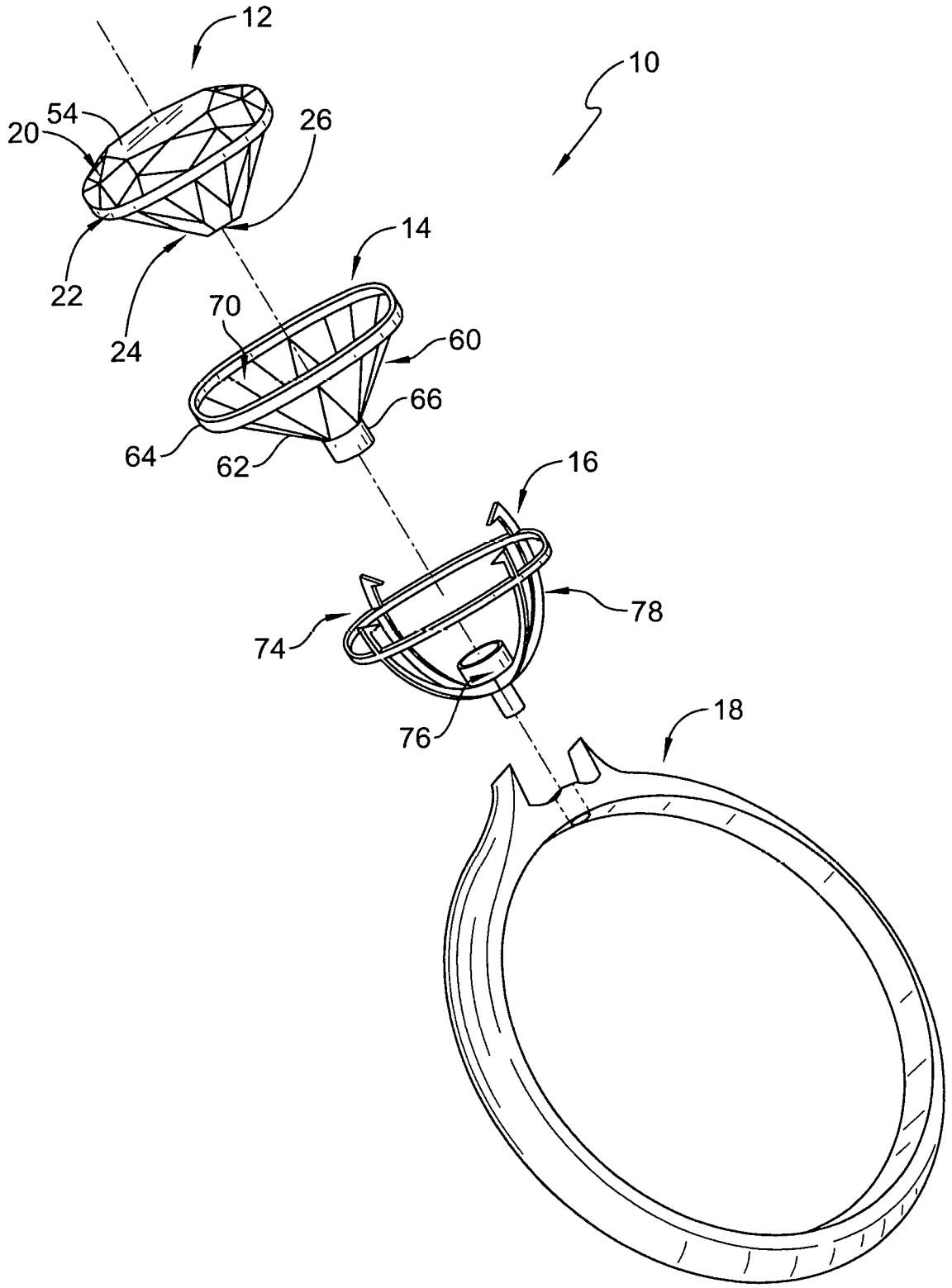

| | | | | |
|---|---|---|---|---|
| 1,392,604 | A | 10/1921 | Smith | |
| 1,548,645 | A | 8/1925 | Akeson | |
| 1,812,058 | A | 6/1931 | Paul | |
| 4,089,096 | A | 5/1978 | Michael | |
| 4,353,765 | A | 10/1982 | Covi | |
| 4,781,038 | A | 11/1988 | Branca | |
| 4,942,744 | A | 7/1990 | Wei | |
| 5,022,238 | A | 5/1991 | German | |
| 5,323,300 | A | 6/1994 | MCrary | |
| 5,519,591 | A | 5/1996 | McCrary | |
| 5,690,412 | A * | 11/1997 | Sheldon | A44C 15/0015 362/104 |
| 5,758,945 | A | 6/1998 | Lima | |
| 6,000,240 | A | 12/1999 | Noda | |
| 6,422,038 | B1 | 7/2002 | Chin | |
| 6,711,915 | B2 | 3/2004 | Quach | |
| 6,928,834 | B2 | 8/2005 | Robertson | |
| 6,990,833 | B2 | 1/2006 | Smith | |
| 6,997,014 | B2 | 2/2006 | Starcke | |
| 7,222,980 | B1 | 5/2007 | Pinciaro | |
| 7,526,928 | B1 | 5/2009 | Kearnes | |
| D632,205 | S | 2/2011 | Mehta | |
| 8,769,987 | B2 | 7/2014 | Mehta | |
| 8,844,319 | B2 | 9/2014 | Weingarten | |
| 9,462,859 | B2 | 10/2016 | Disinger | |
| 2002/0134107 | A1 | 9/2002 | Meguro | |
| 2002/0152767 | A1 | 10/2002 | Gruber | |
| 2002/0166339 | A1 | 11/2002 | Adelman | |
| 2003/0221452 | A1 | 12/2003 | Morbidoni | |
| 2004/0083759 | A1 | 5/2004 | Starcke | |
| 2005/0044890 | A1 | 3/2005 | Lodholz | |
| 2006/0000236 | A1 | 1/2006 | Chan | |
| 2007/0006615 | A1 | 1/2007 | Noda | |
| 2007/0036921 | A1 | 2/2007 | Twitchen | |
| 2007/0157667 | A1 | 7/2007 | Maltezos | |
| 2008/0087042 | A1 | 4/2008 | Heimann | |
| 2008/0104994 | A1 | 5/2008 | Braunwart | |
| 2009/0038341 | A1 | 2/2009 | Zheng | |
| 2009/0260396 | A1 | 10/2009 | Broukman | |
| 2011/0030422 | A1 | 2/2011 | Kang | |
| 2011/0110201 | A1 | 5/2011 | Boularas | |
| 2011/0194276 | A1 * | 8/2011 | Au | A44C 15/0015 362/104 |
| 2012/0060557 | A1 | 3/2012 | Looveren | |
| 2012/0096898 | A1 | 4/2012 | Van Looveren | |
| 2013/0227989 | A1 | 9/2013 | Kothari | |
| 2015/0007610 | A1 | 1/2015 | Greulich | |
| 2015/0068248 | A1 | 3/2015 | Conner | |
| 2015/0075217 | A1 | 3/2015 | Disinger | |
| 2016/0353847 | A1 | 12/2016 | Disinger | |
| 2018/0033919 | A1 * | 2/2018 | Lee | F21V 33/00 |
| 2019/0037978 | A1 | 2/2019 | Haramein | |

FOREIGN PATENT DOCUMENTS

| | | | |
|---|---|---|---|
| GB | 182138 | | 9/1923 |
| GB | 2136672 | A | 9/1984 |
| JP | 8103310 | A | 4/1996 |
| KR | 1020120025050 | A | 3/2012 |
| RU | 164561 | U1 | 9/2016 |
| WO | 200069303 | | 11/2000 |
| WO | 2009121908 | | 10/2009 |
| WO | 2014023064 | | 2/2014 |

OTHER PUBLICATIONS

International (PCT) Search Report and Written Opinion for PCT/US2018/000249 dated Dec. 20, 2018, BD-105 PCT || (62279-285112). 10 pages.

US Office Action for U.S. Appl. No. 15/239,907 dated Sep. 1, 2017, BD-101 US-CON || (62279-258143)), 10 pages.

Office Action dated Jul. 17, 2018 for U.S. Appl. No. 15/239,907, BD-101 US-CON1 || (5723-258143)(pp. 1-12).

Office Action dated Apr. 23, 2019 for U.S. Appl. No. 15/239,907 (pp. 1-13).

* cited by examiner

LIGHT-EMITTING JEWELRY

BACKGROUND

The present disclosure relates to jewelry, and particularly to jewelry including a gemstone. More particularly, the present disclosure relates to jewelry configured to communicate light through the gemstone.

SUMMARY

According to the present disclosure, a jewelry piece includes a gemstone. The gemstone may be a piece of material used to make an adornment such as, for example, a mineral, a crystal, metal, rock, plastic, glass, cubic zirconia, colored gemstone, whether precious or non-precious, natural diamond, and lab-created diamond. In some embodiments, the jewelry piece further includes a head. The head interconnects the gemstone to a mounting for securing the jewelry piece to a person or a personal adornment.

In some embodiments, the jewelry piece is a light-emitting jewelry piece including a gemstone and a light-emission system. The light-emission system is configured to provide means for emitting light over time in response to receiving and storing light to cause light visible to a person to be emitted through the gemstone. The light emitted through the gemstone may be more visible by a person when the light-emitting jewelry is in a dusk to dark environment.

In some embodiments, the gemstone includes a crown, a girdle, a pavilion, and a culet. The girdle is formed to include a channel that extends into the girdle and that opens away from the gemstone. The light-emission system includes a light-emitting band that is coupled to an exterior surface of the gemstone and extends into the channel formed in the girdle. The light-emitting band is configured to emit light over time in response to receiving and storing light to cause visible light to be emitted through the gemstone.

In some embodiments, the channel formed in the girdle is a V-shaped channel defined by an upper-inclined surface and a lower-inclined surface. The upper and lower-inclined surfaces converge toward each other and define a channel angle therebetween. In some embodiments, the channel angle is about 90 degrees or less.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

Figure 2:
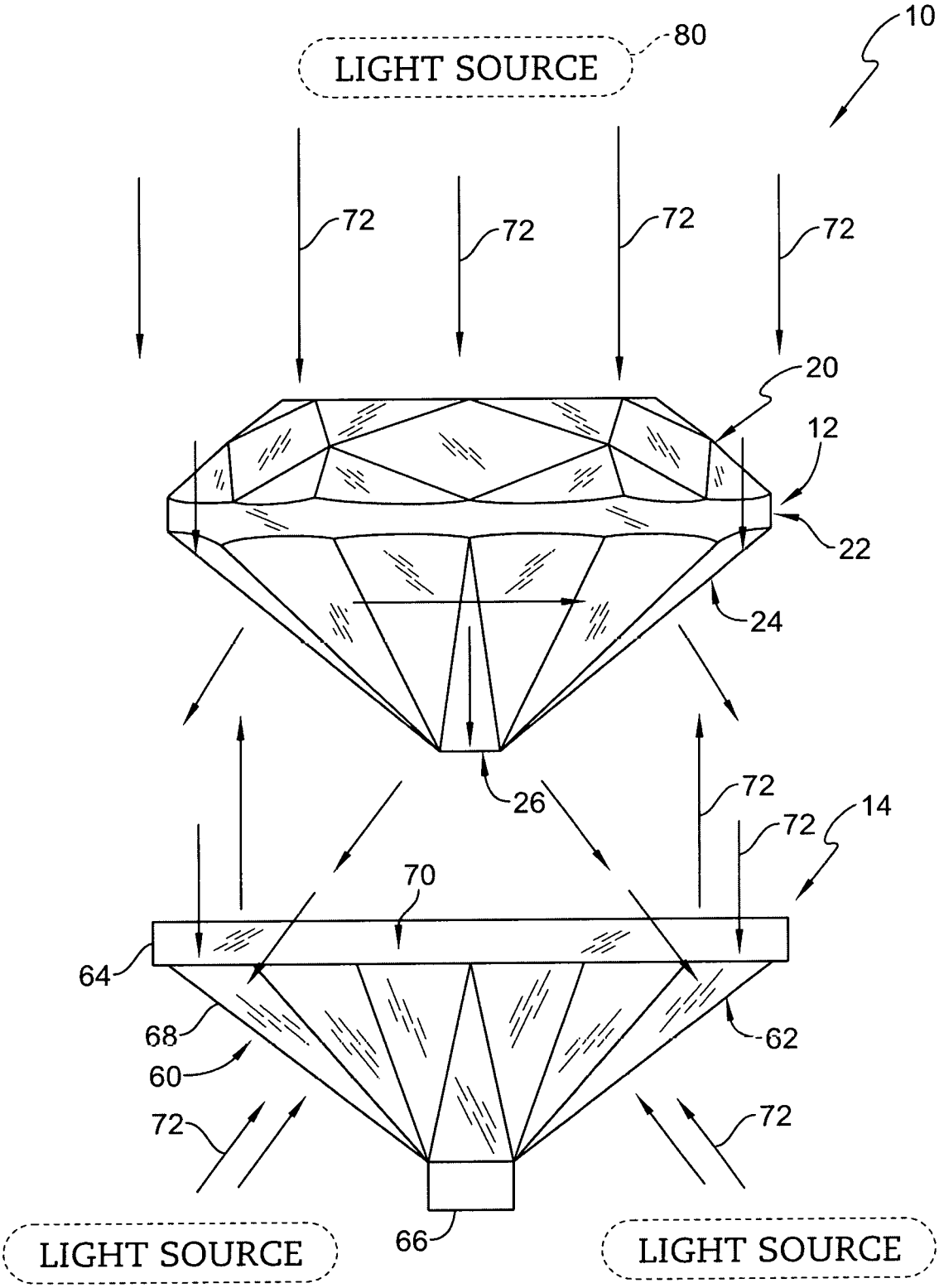
Figure 4:
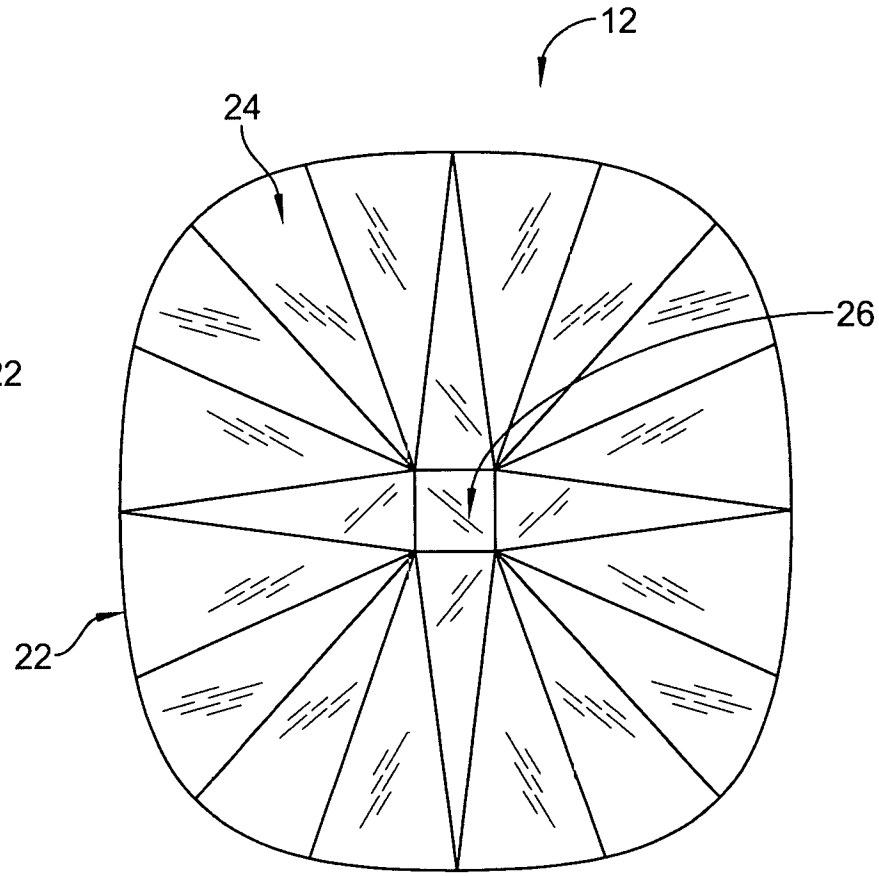
Figure 3:
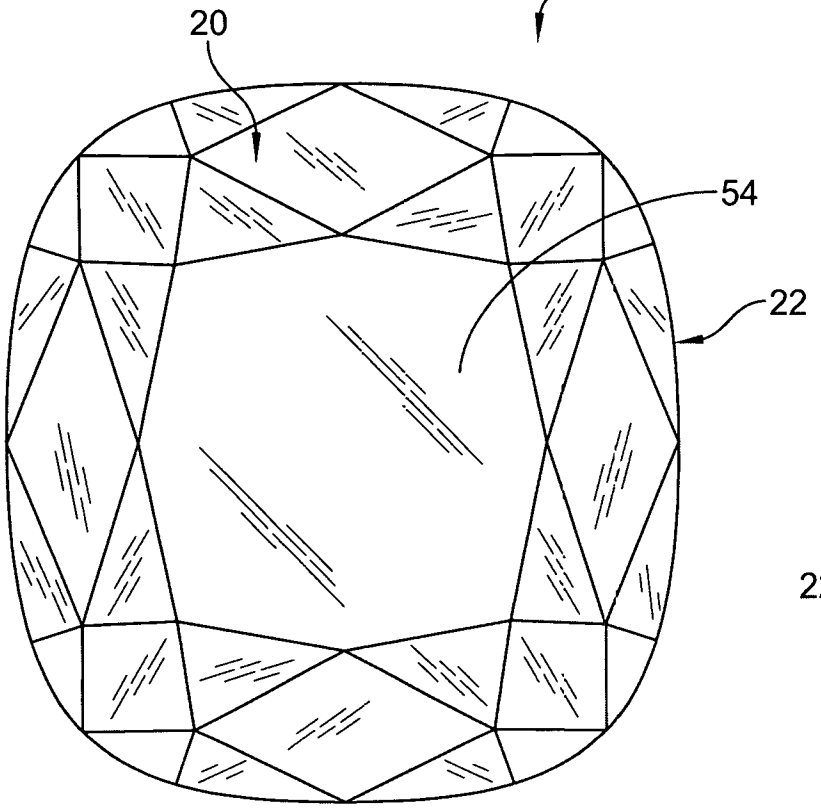
Figure 5:
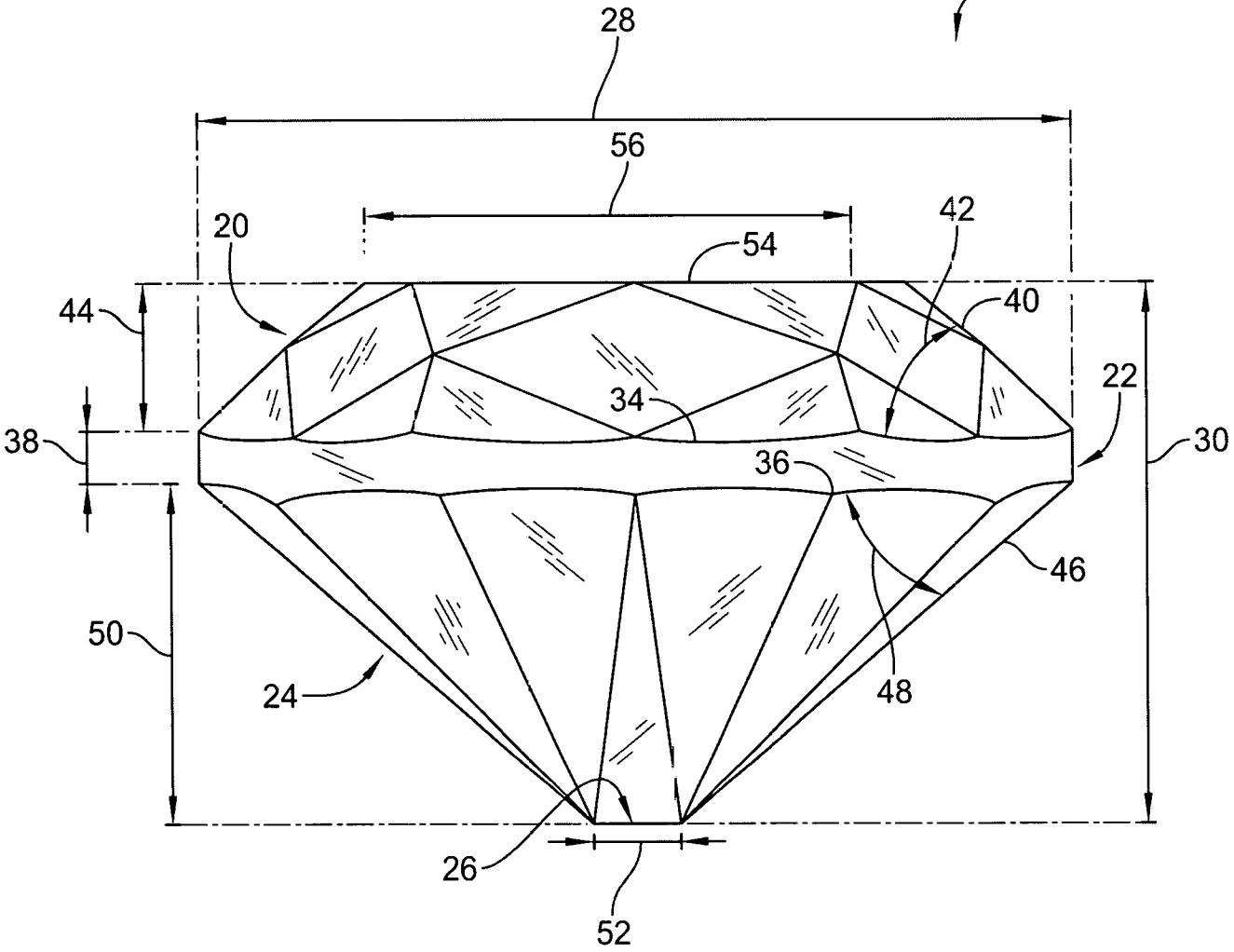
Figure 7:
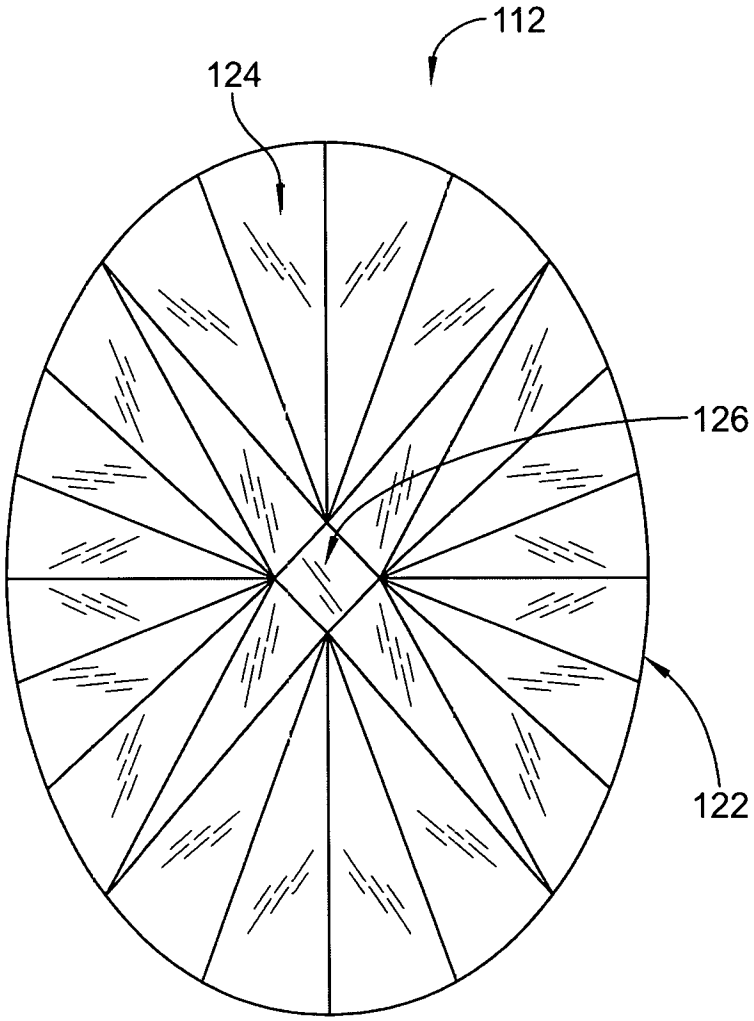
Figure 6:
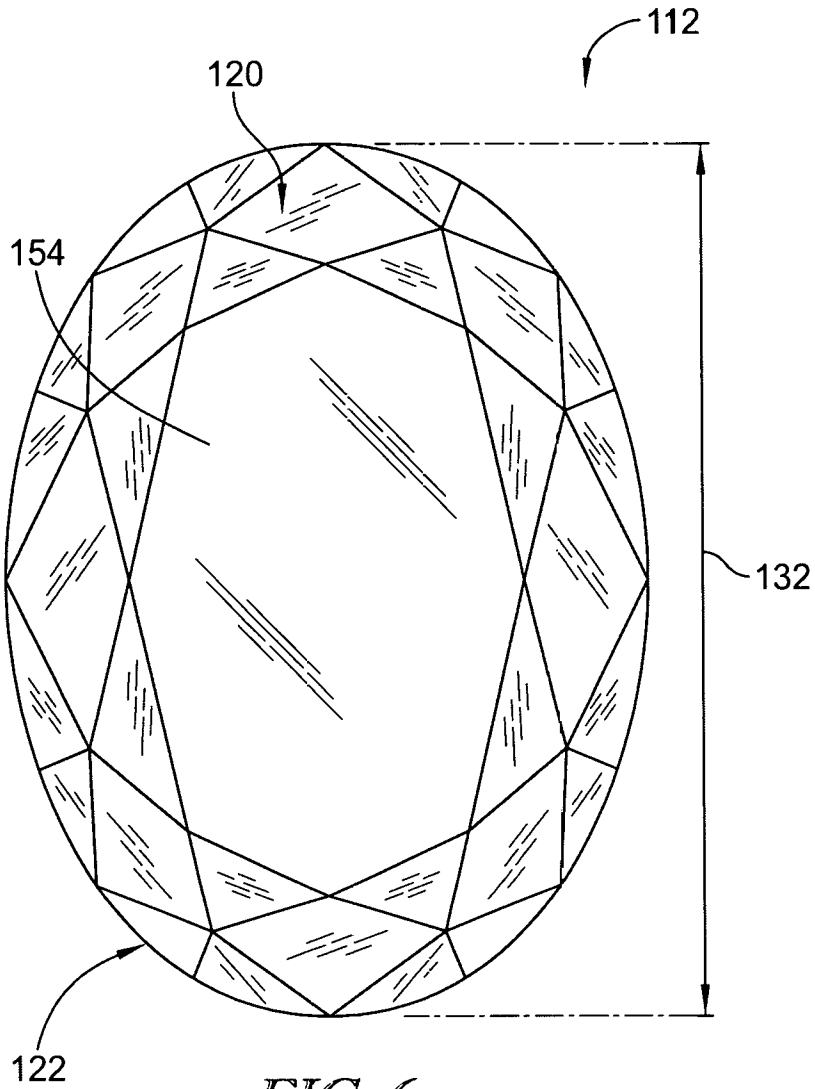
Figure 8:
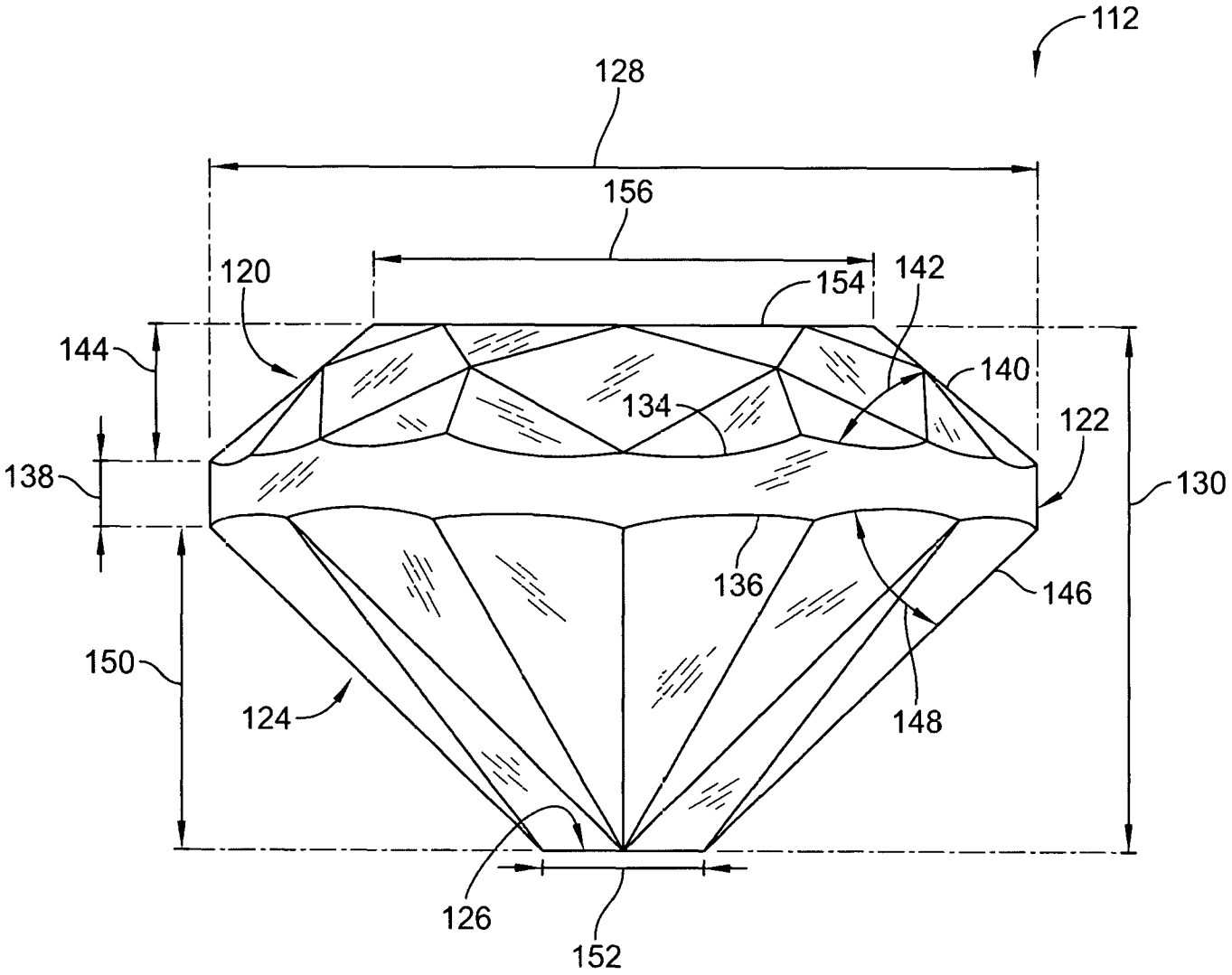
Figure 9:
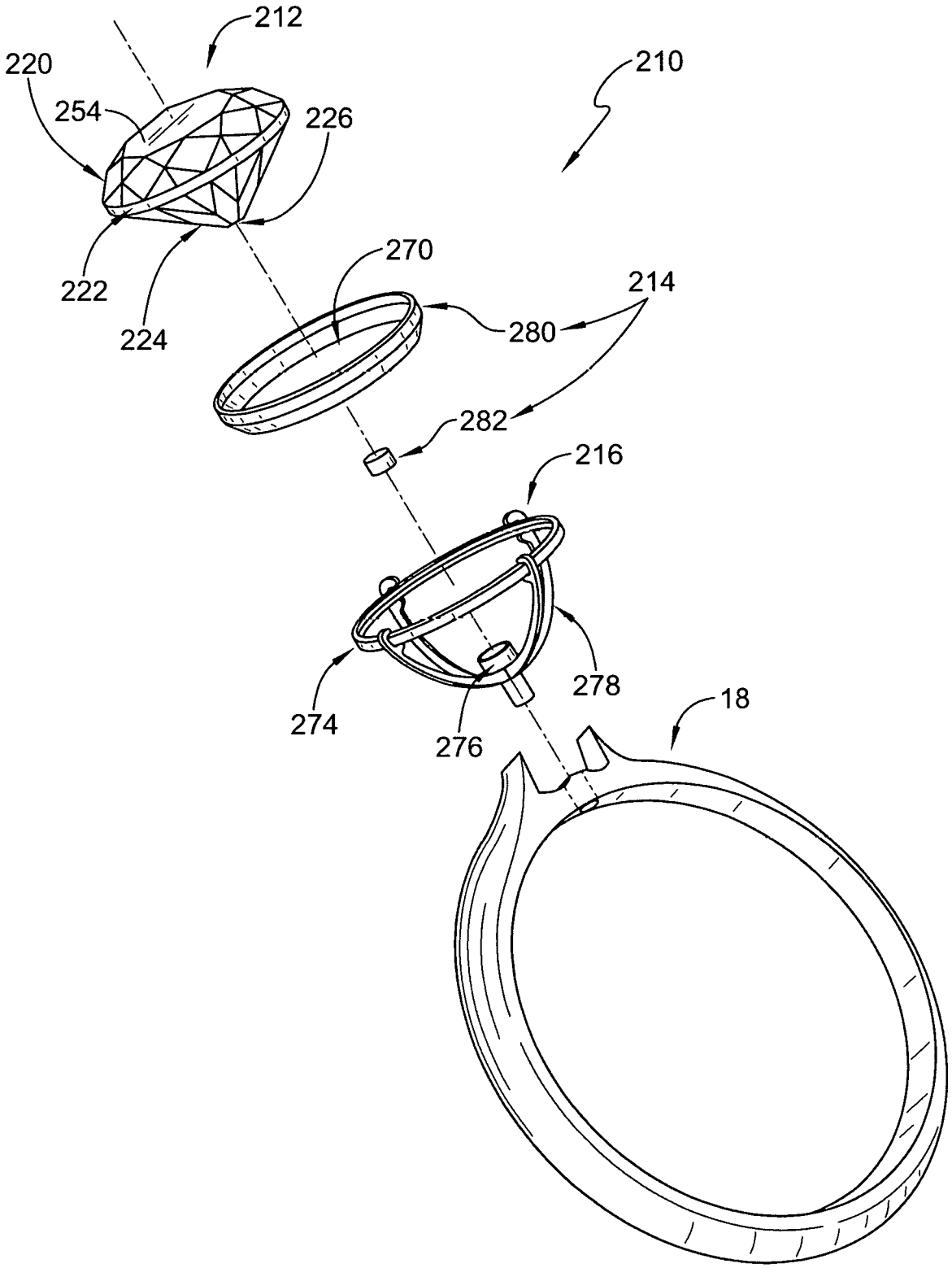
Figure 10:
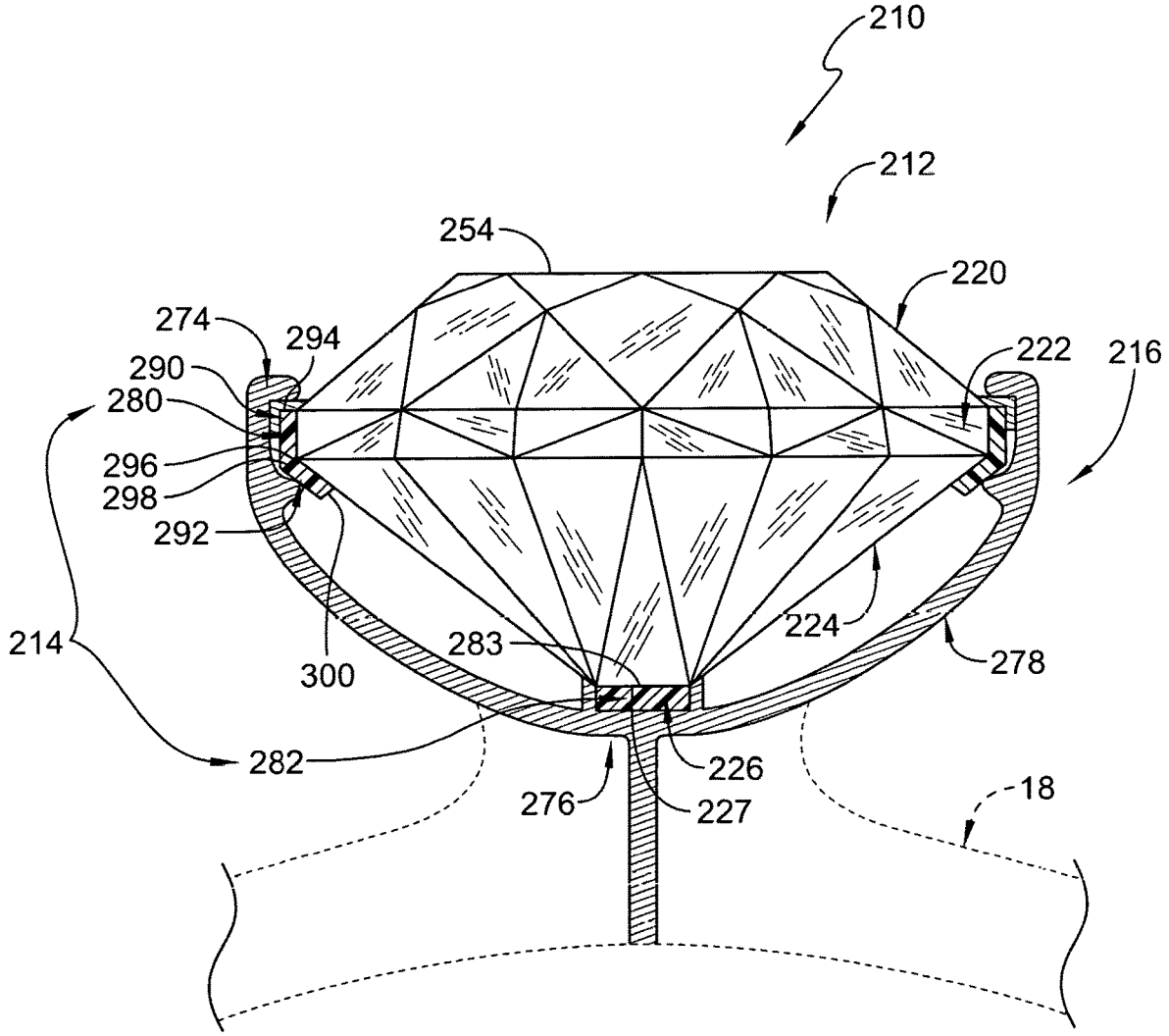
Figure 11:
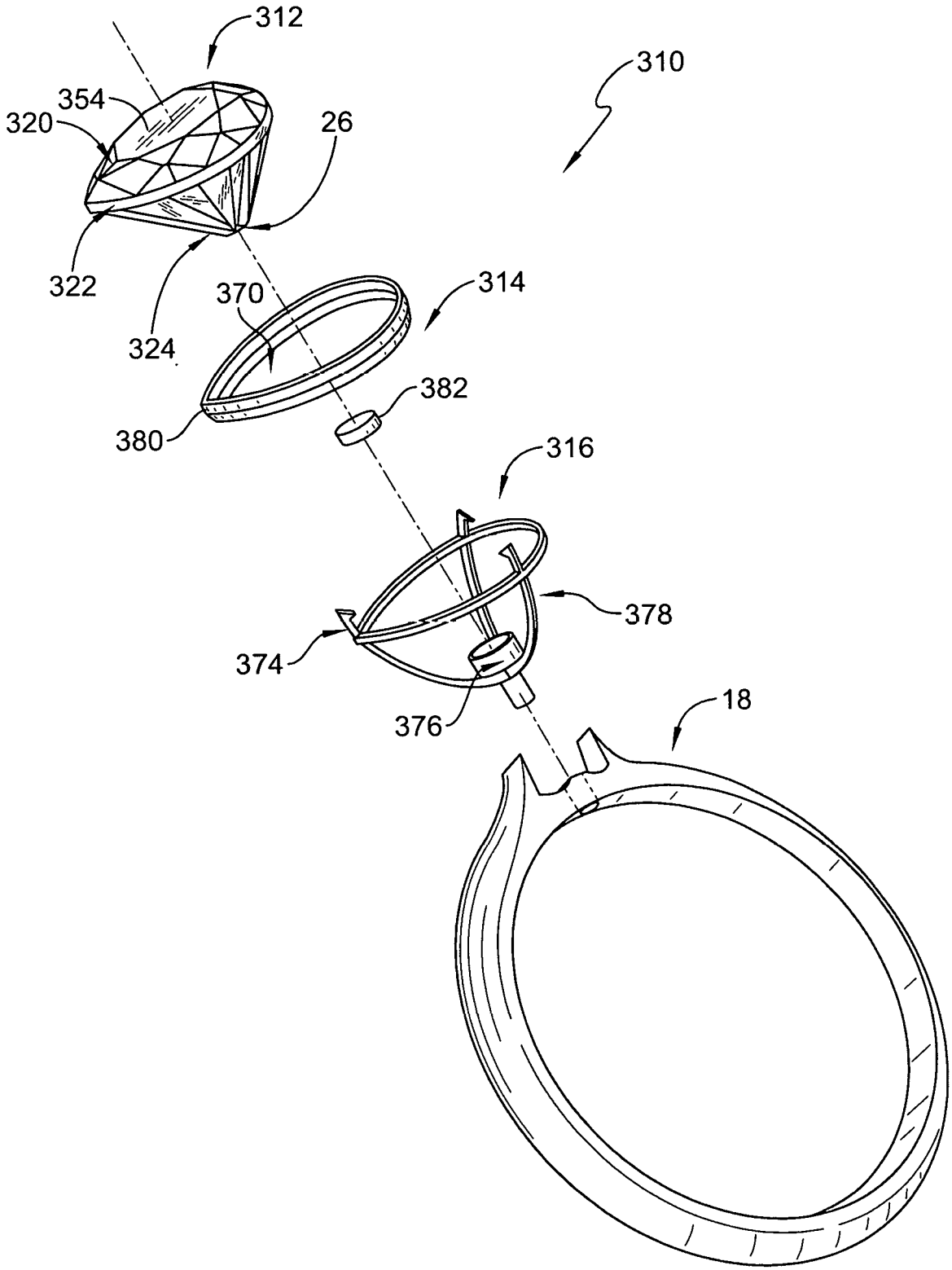
Figure 13:
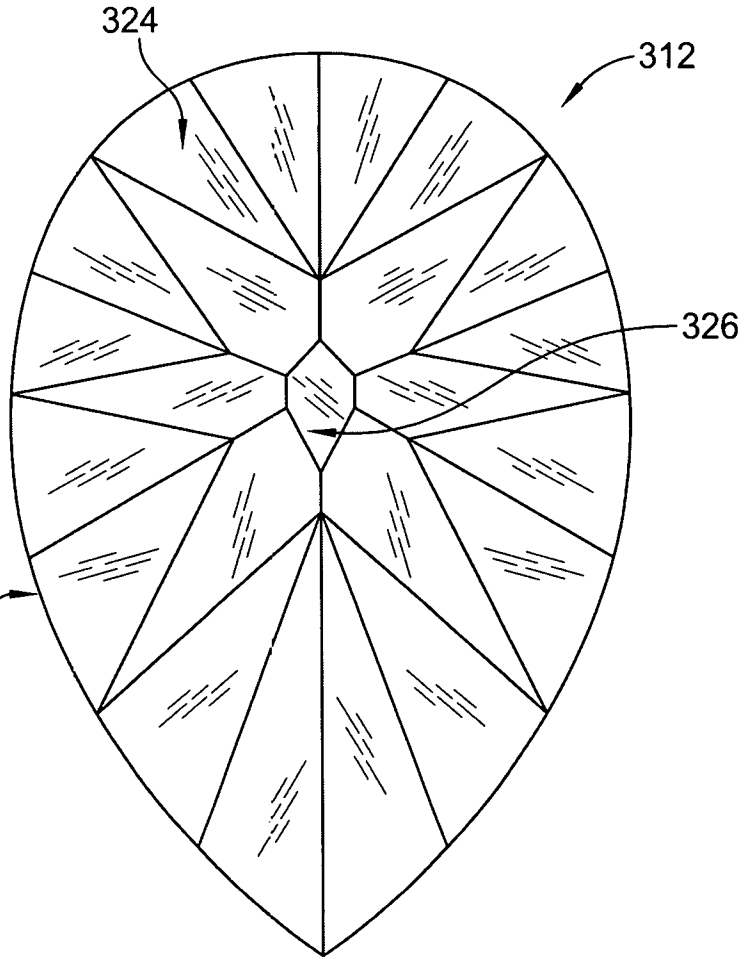
Figure 12:
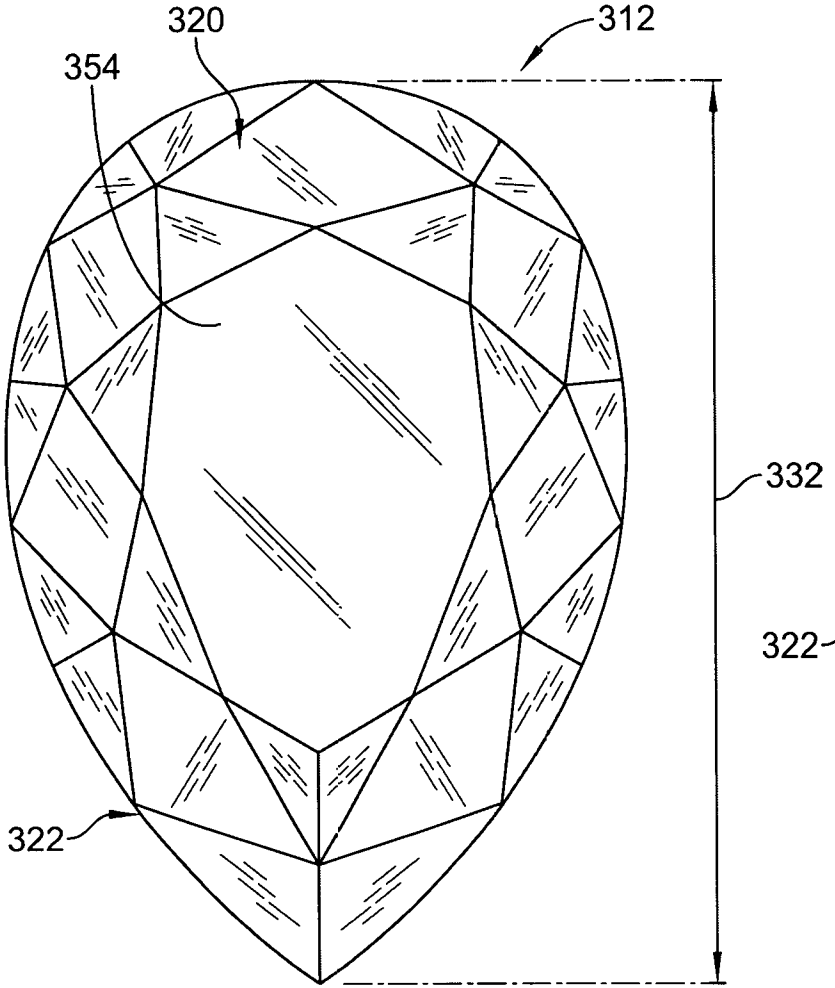
Figure 14:
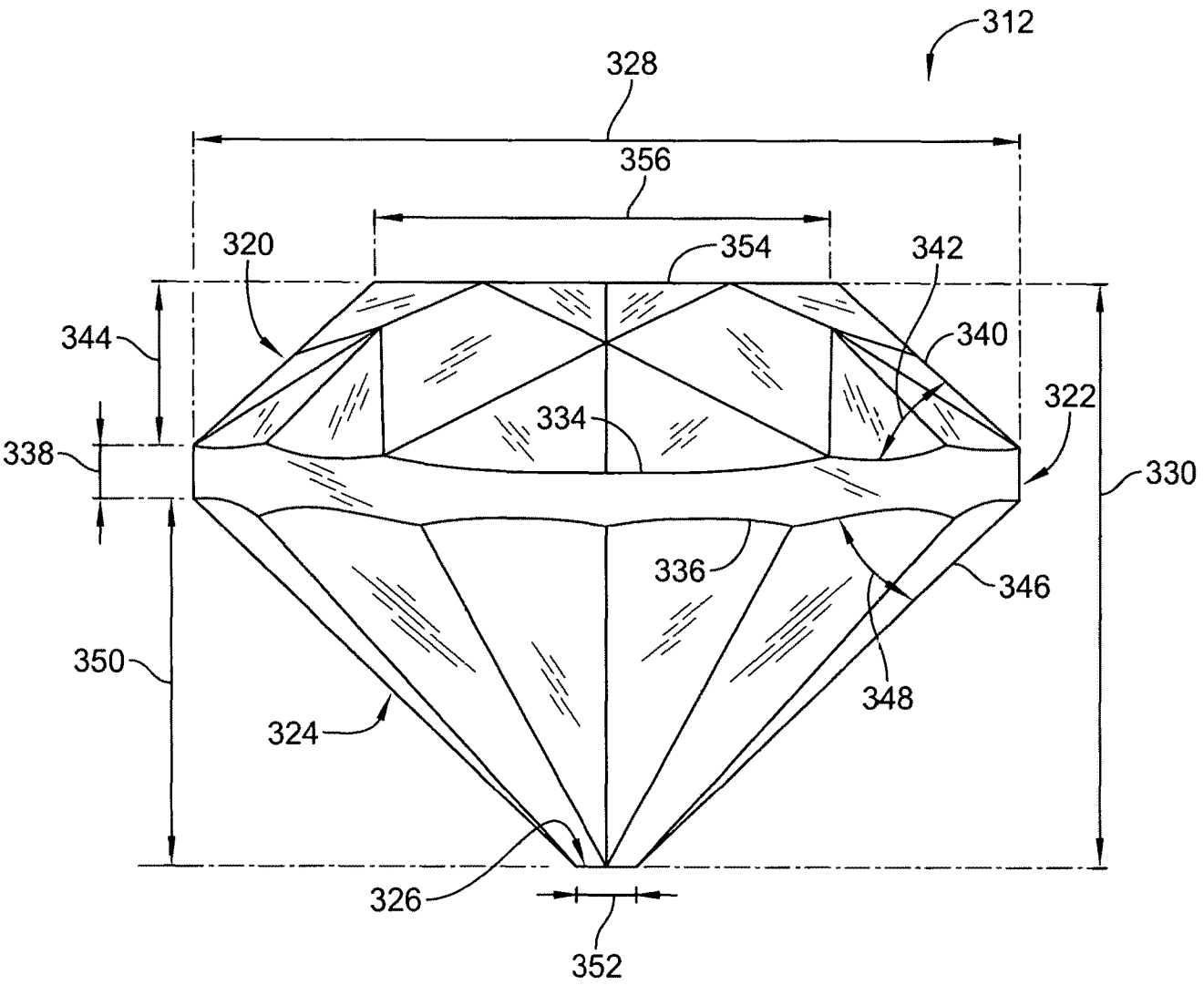
Figure 15:
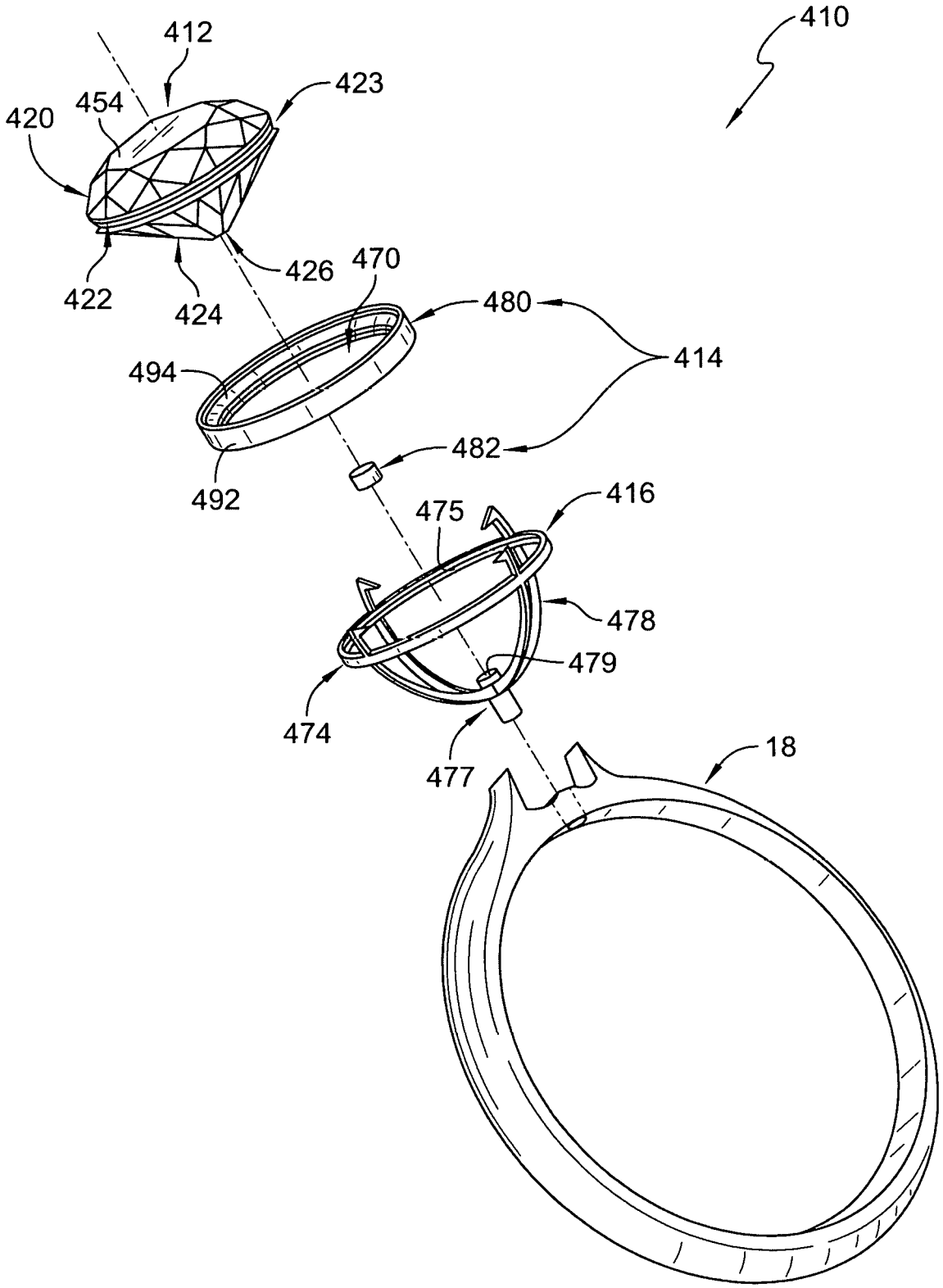
Figure 16:
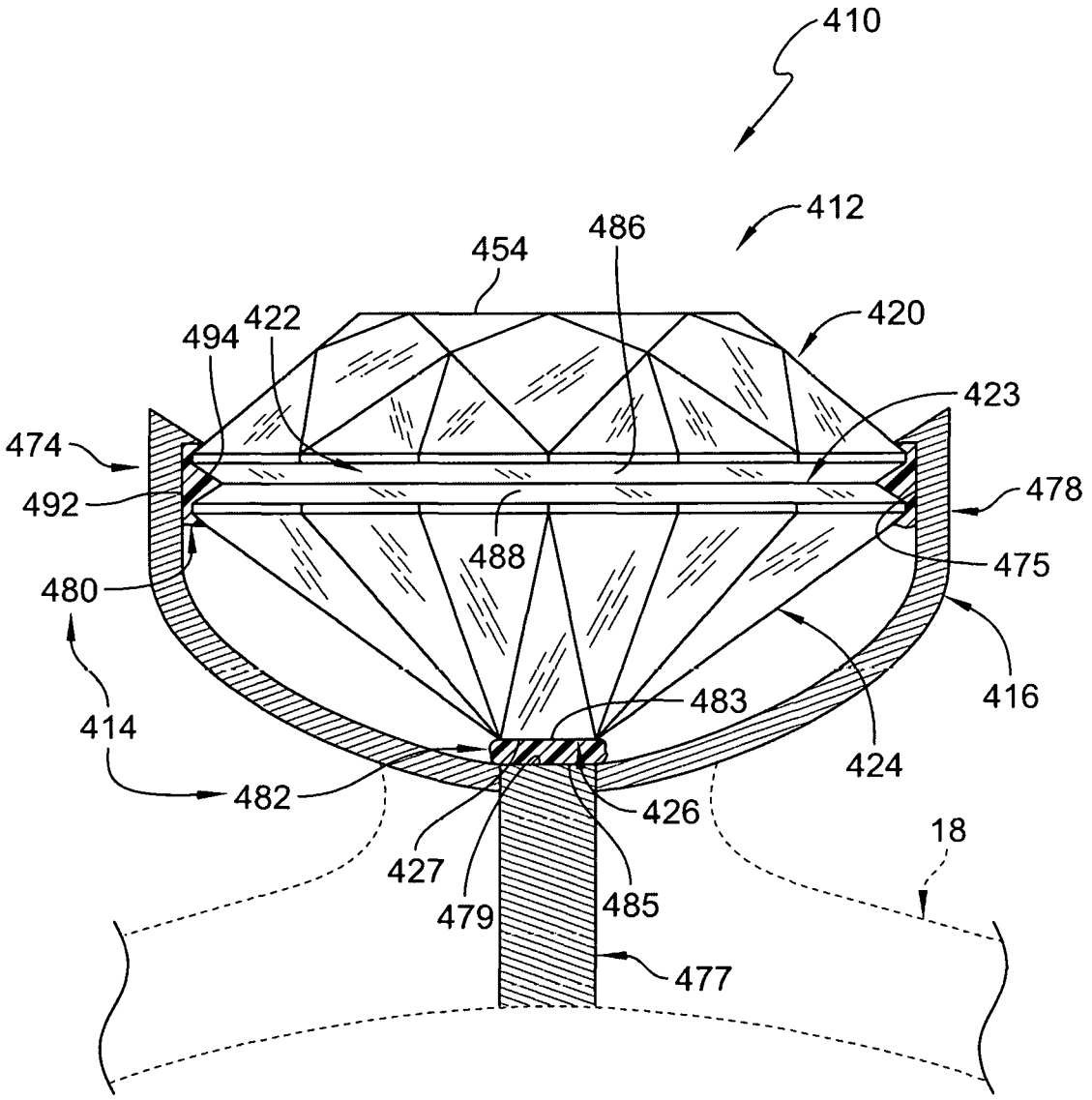
Figure 17:
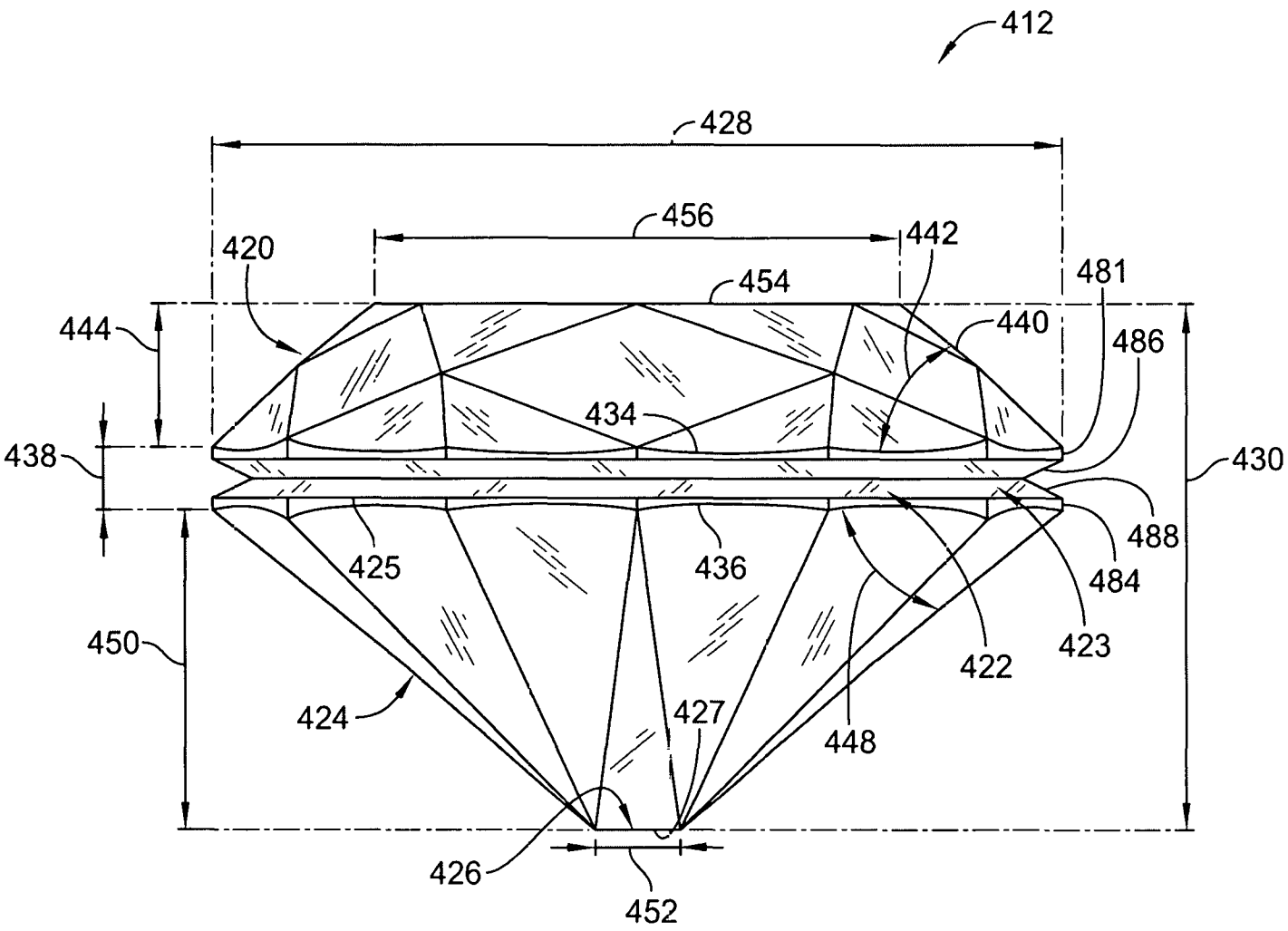
Figure 18:
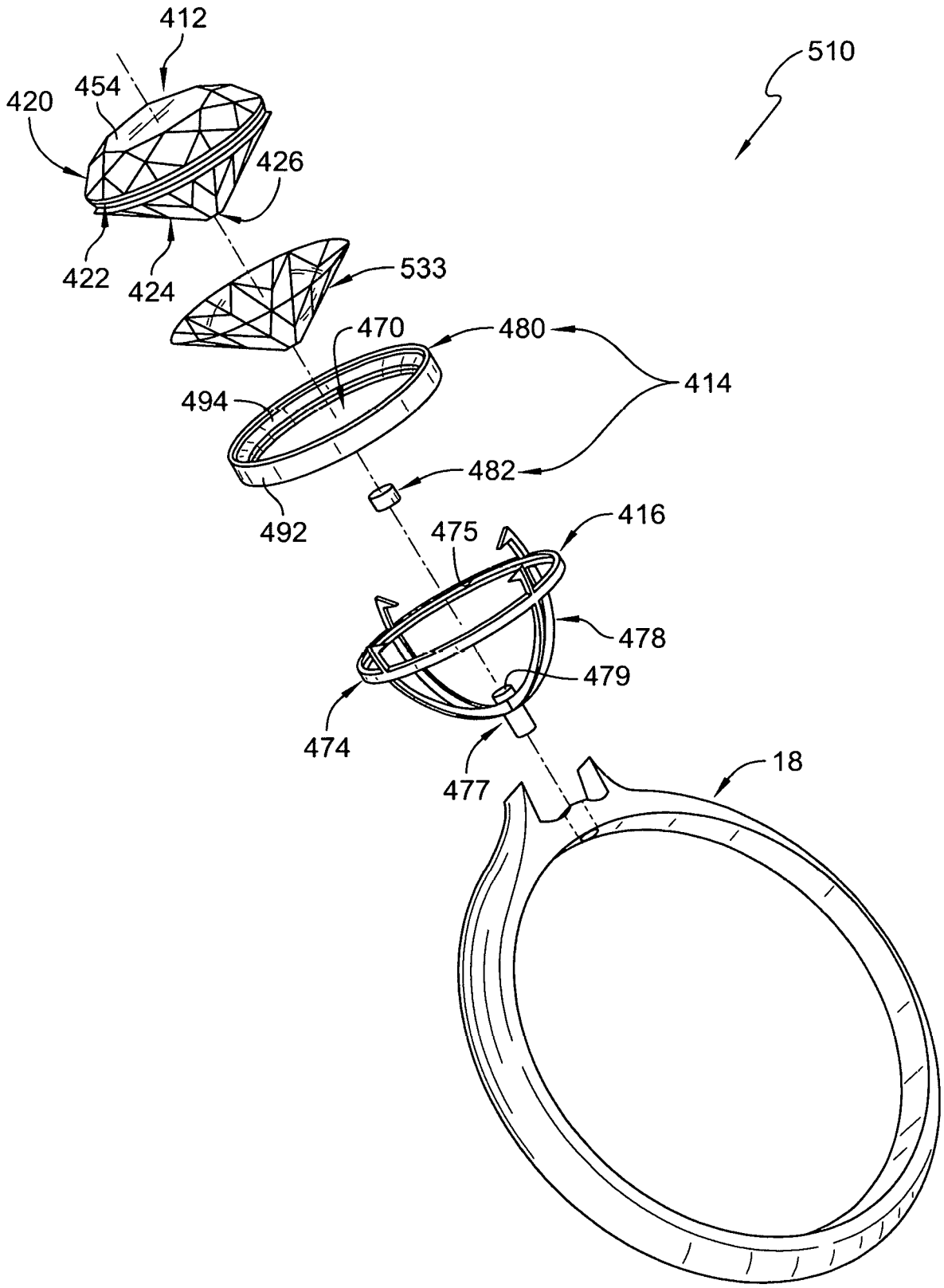
Figure 19:
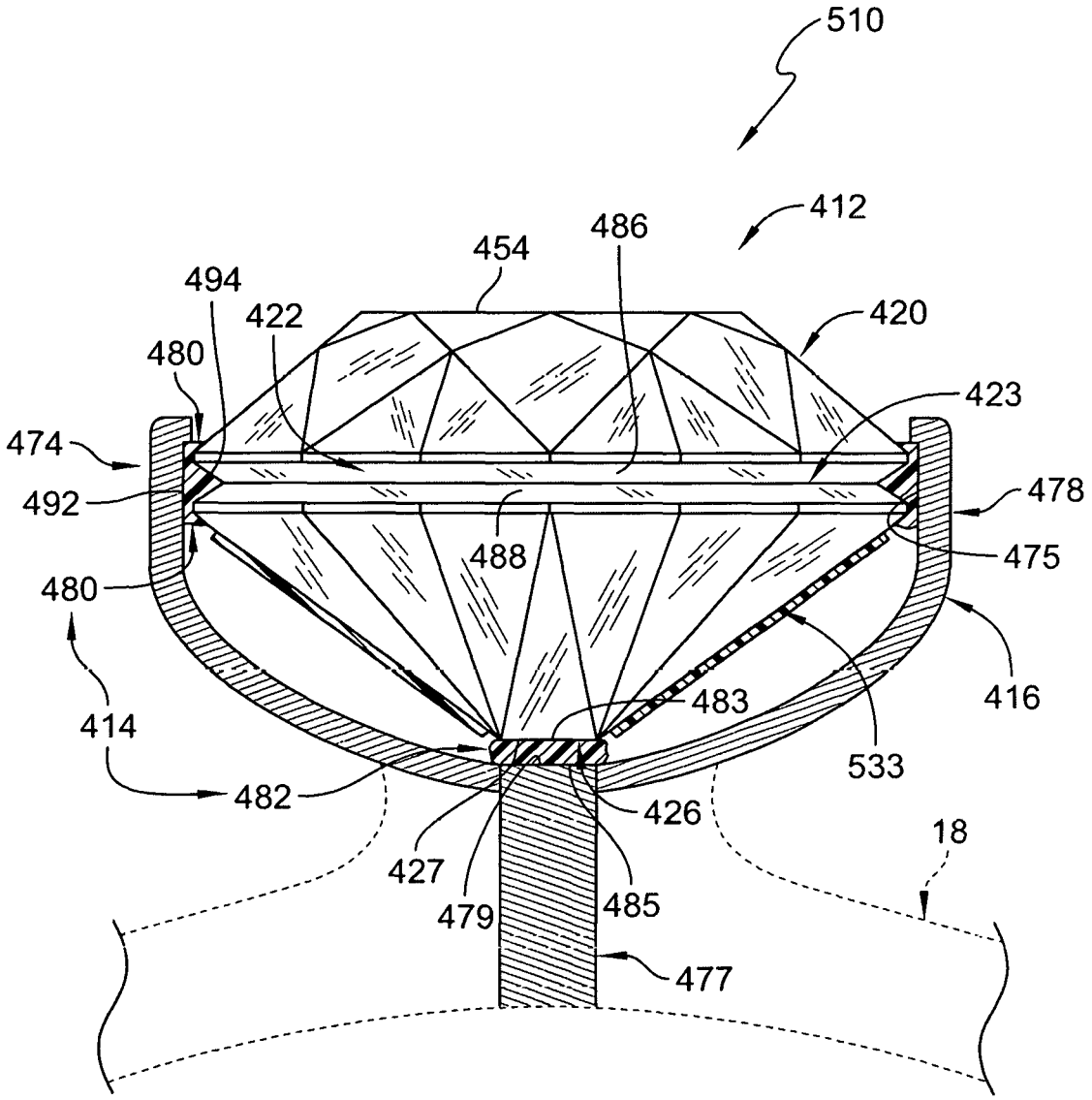
Figure 20:
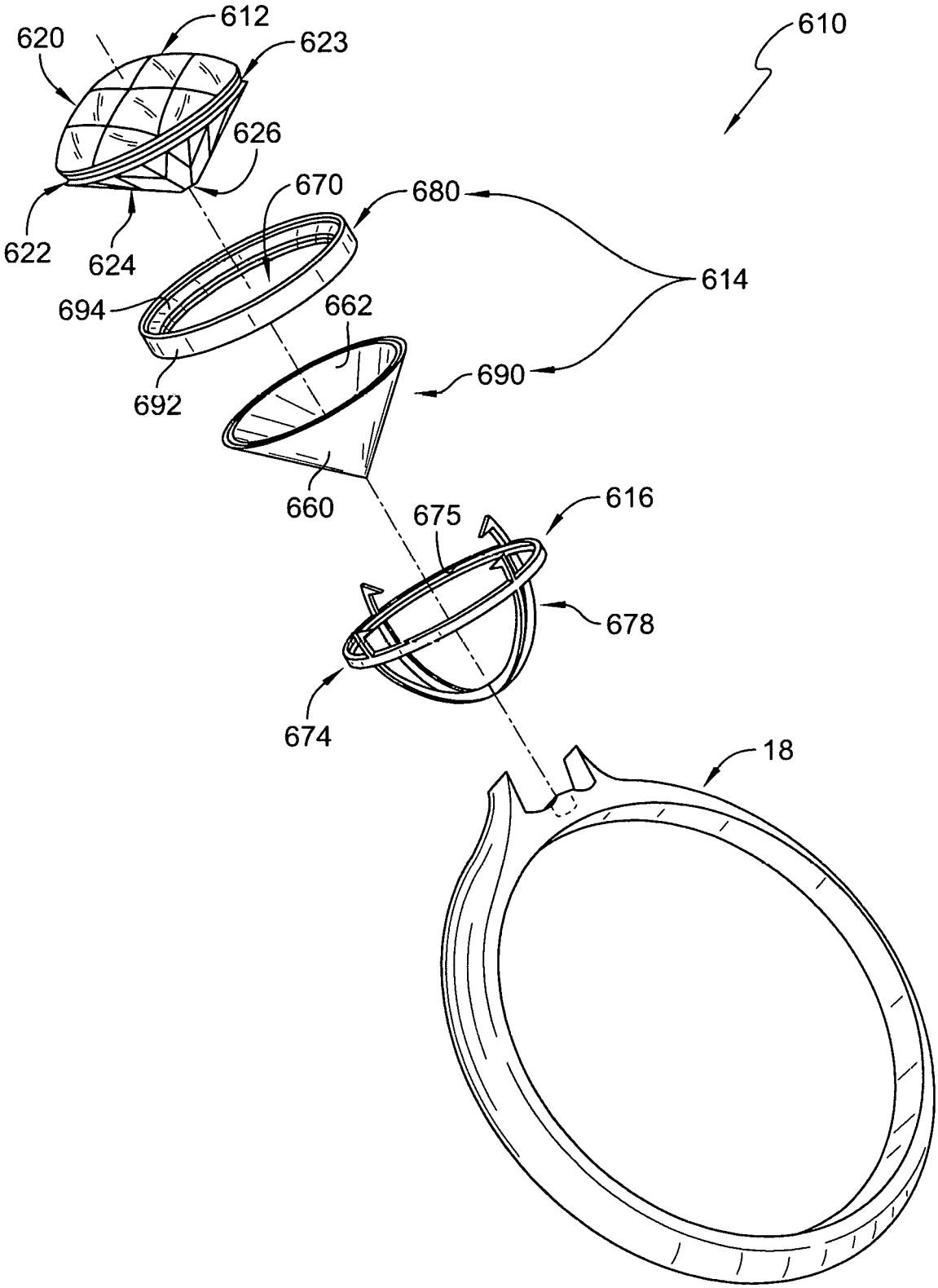
Figure 21:
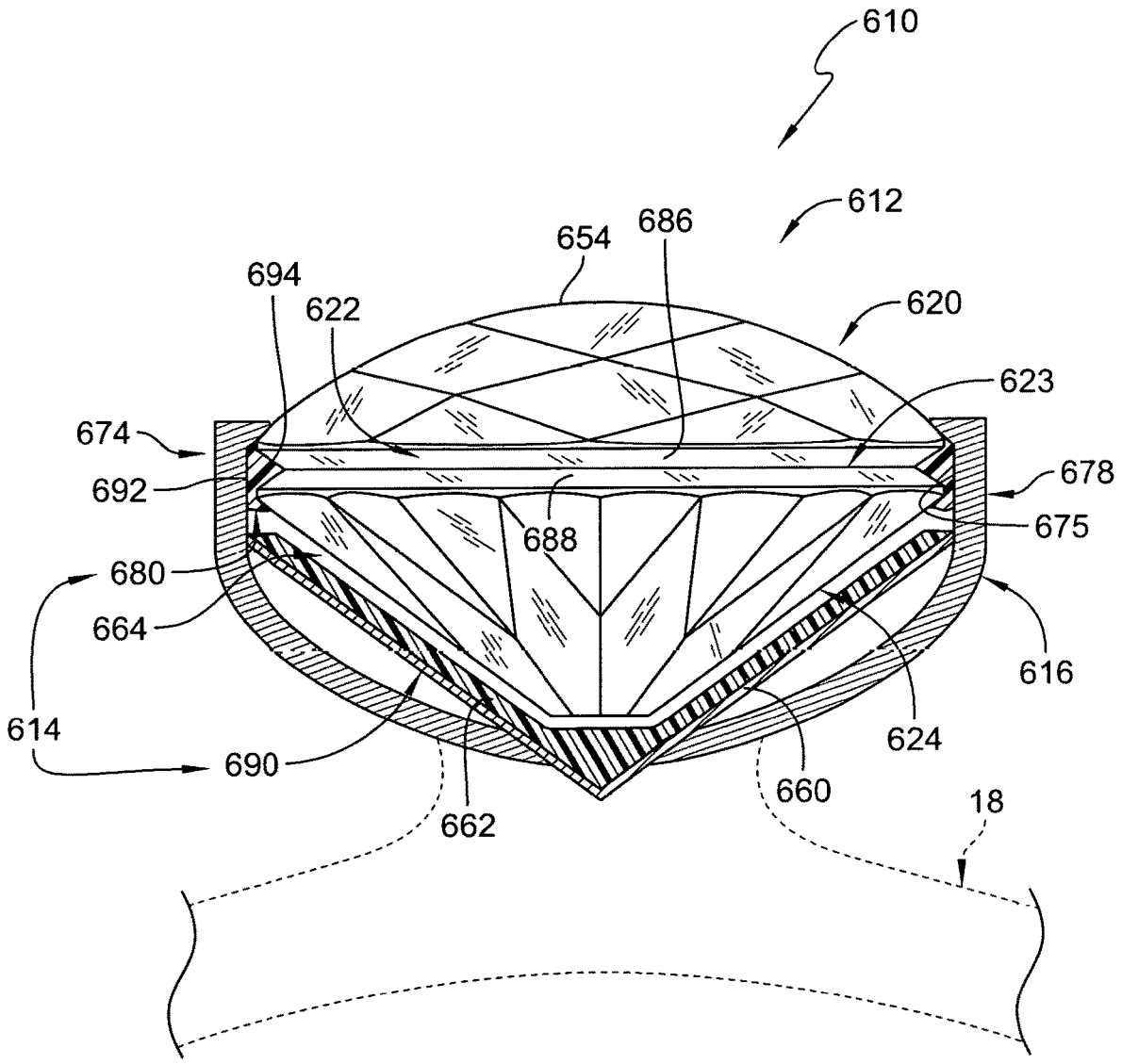
Figure 21A:
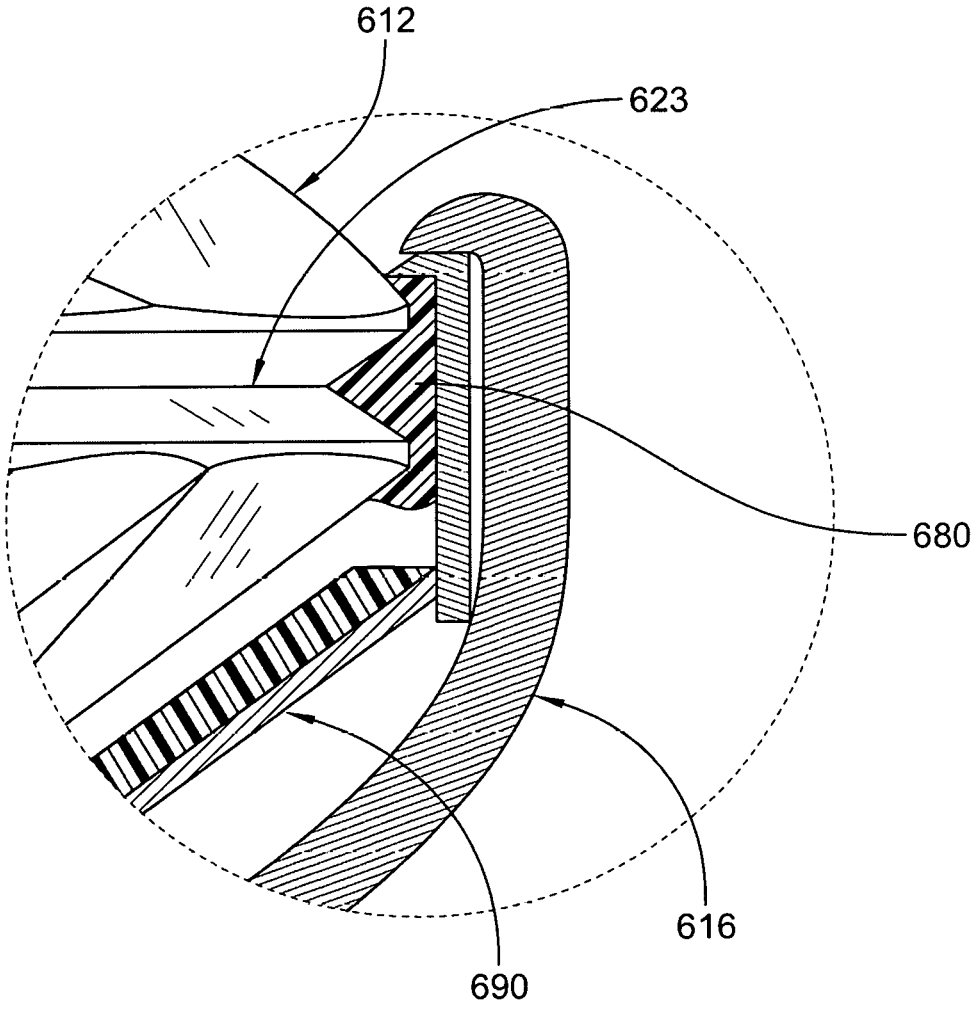
Figure 22:
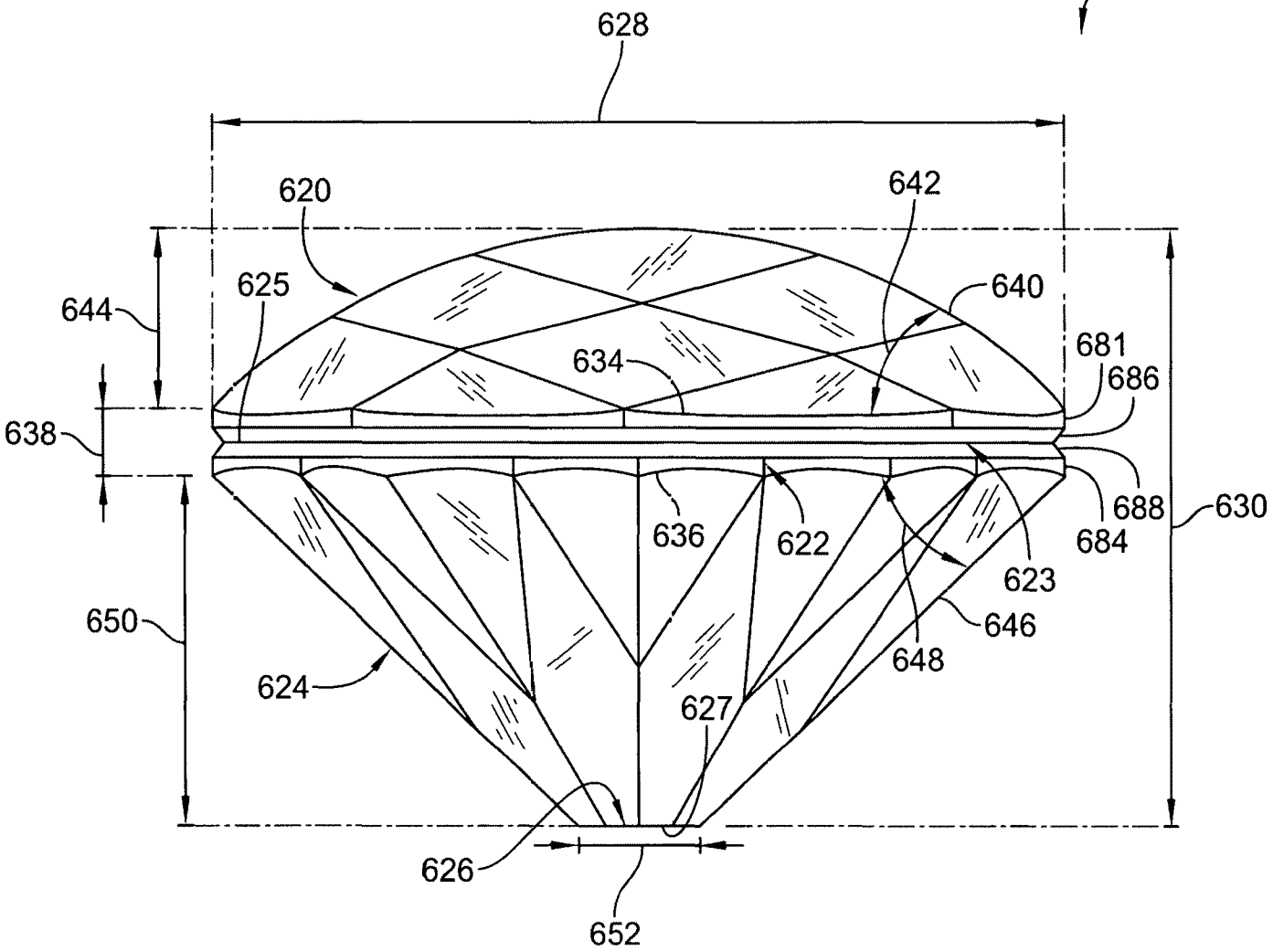
Figure 23:
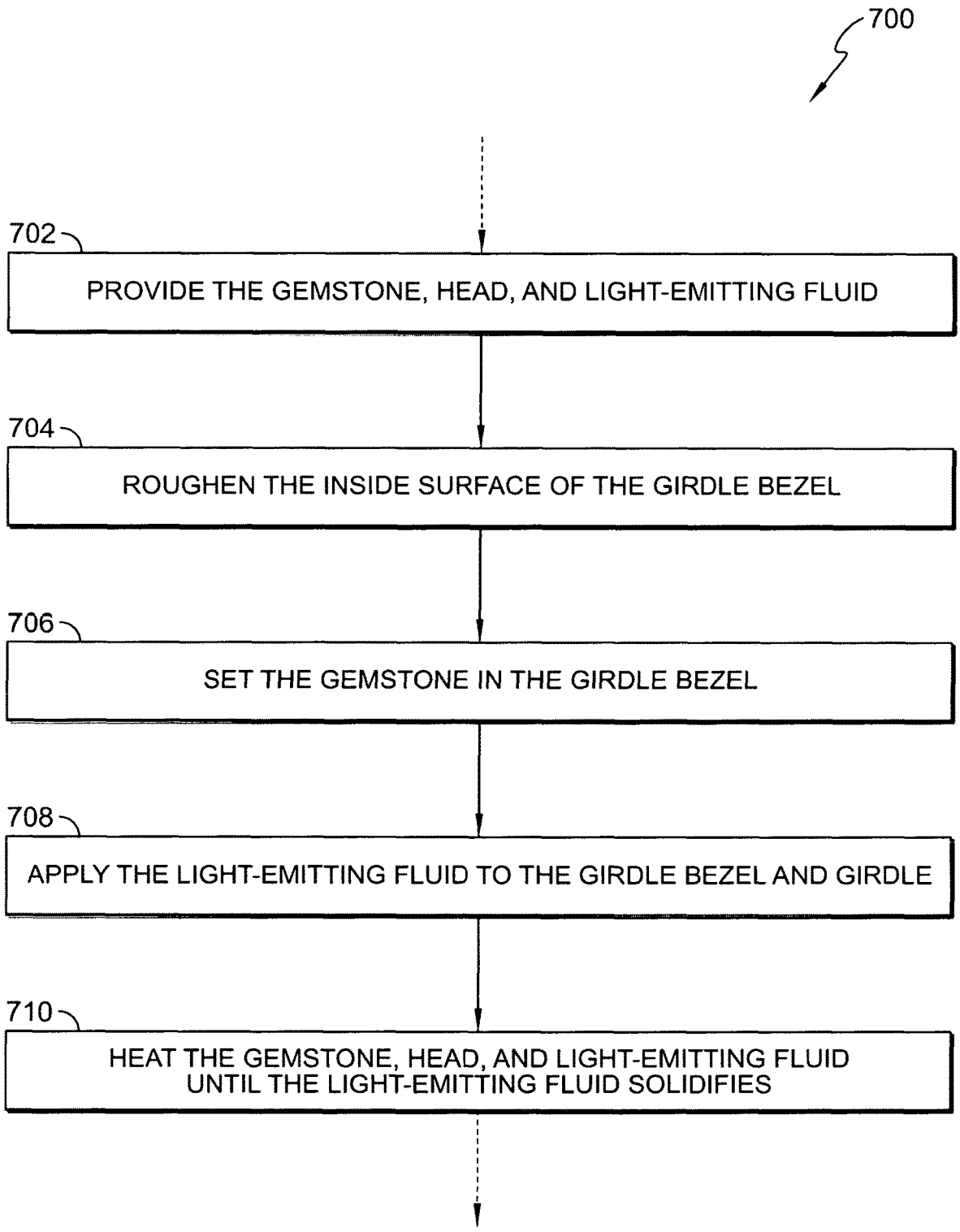
Figure 24:
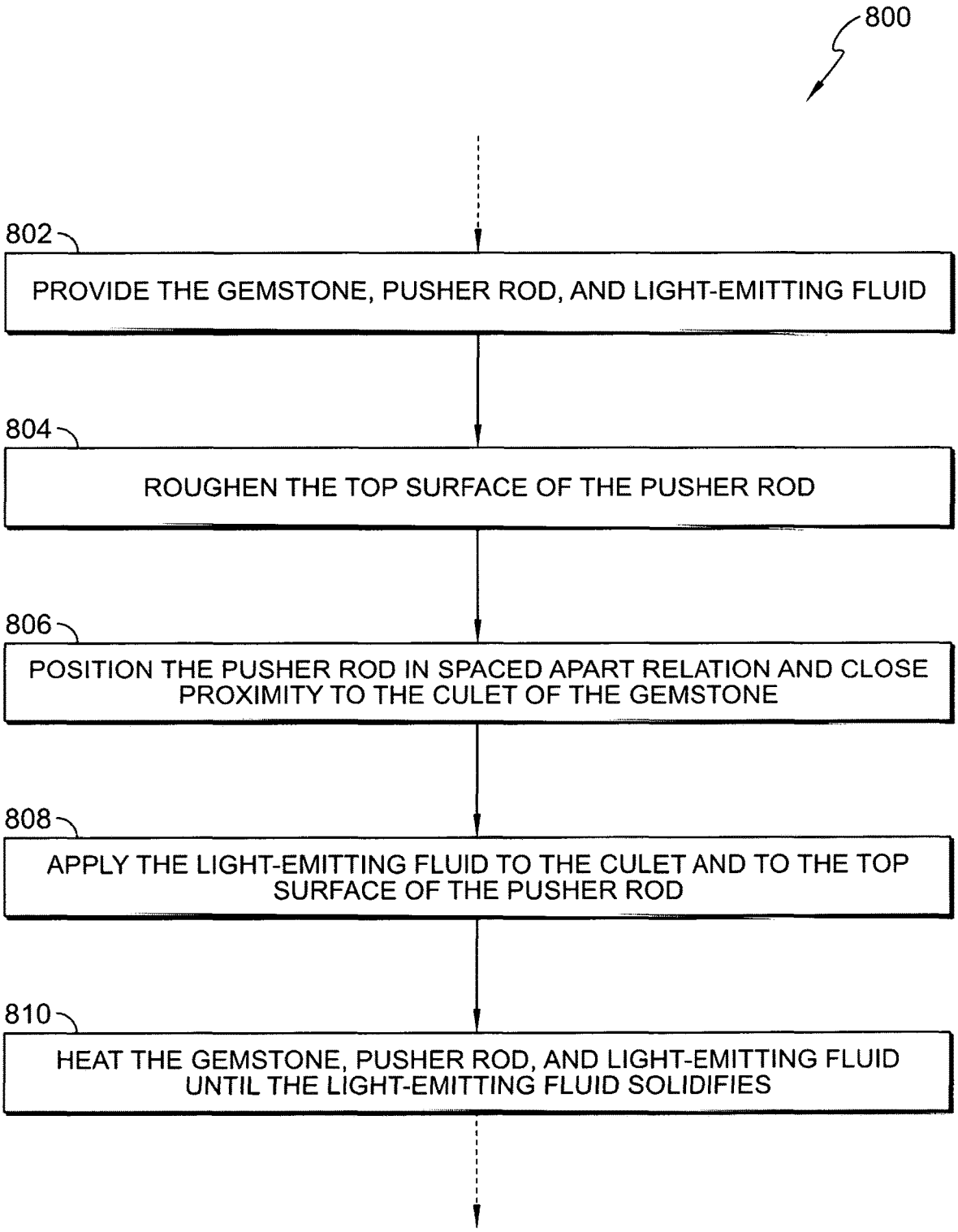
Figure 25:
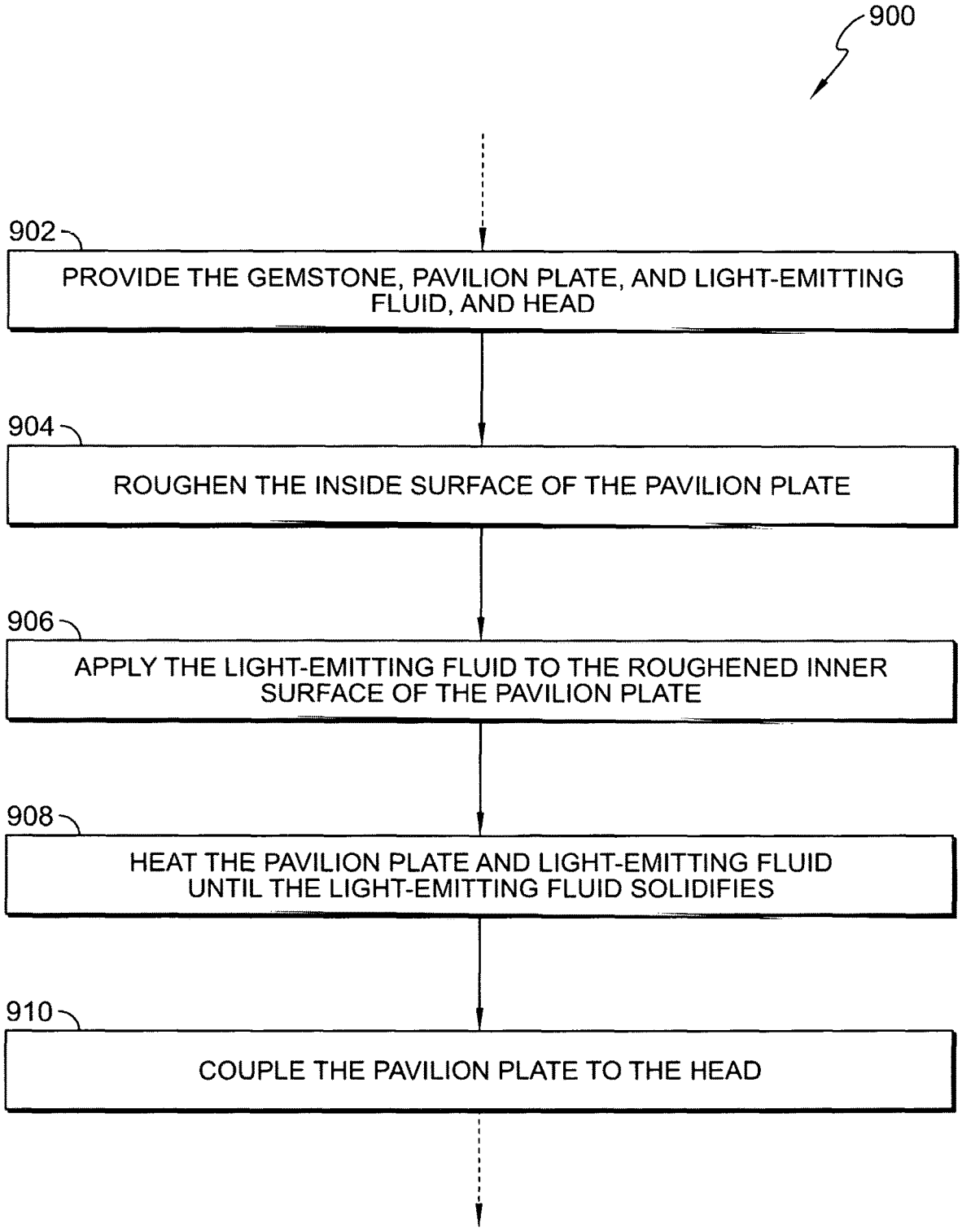

The detailed description particularly refers to the accompanying figures in which:

FIG. 1 is an exploded perspective view of a light-emitting jewelry piece in accordance with the present disclosure showing that the light-emitting jewelry piece includes, from top to bottom, a gemstone, a light-emission system arranged to receive the gemstone and to discharge light through the gemstone, a head arranged to support the gemstone and the light-emission system, and a mount arranged to secure the light-emitting jewelry piece to a person or personal adornment;

FIG. 2 is a diagrammatic and elevation view showing the gemstone of FIG. 1 spaced apart from the light-emission system, and further showing that the gemstone includes, from top to bottom, a crown, a relatively thick polished girdle, a pavilion, and a relatively large culet, and suggesting how UV light or ambient light emitted from a light source (e.g., sun light or electrical lighting) located above the gemstone enters the gemstone through the crown and is directed out of the gemstone through the pavilion where the light is captured by the light-emission system and emitted back into the gemstone over a period of time;

FIG. 3 is a top view of the gemstone of FIG. 1 showing that the gemstone is a cushion-cut gemstone cut to direct a first portion of light entering the gemstone through the crown and hack up through the crown and the table and to direct a second portion of light entering the gemstone out of the gemstone toward the light-emission system to be captured by the light-emission system and emitted back up into and through the gemstone over a period of time;

FIG. 4 is a bottom view of the cushion-cut gemstone of FIG. 3 showing the relatively large culet of the gemstone and a plurality of facets of the pavilion;

FIG. 5 is an elevation view of the cushion-cut gemstone of FIG. 3 showing that the cushion-cut gemstone includes, from top to bottom, the crown including an outer crown surface having a crown angle defined between the outer crown surface and a top edge of the girdle, the relatively thick girdle having a top edge and a bottom edge spaced apart from the top edge, the pavilion including an outer pavilion surface having a pavilion angle defined between the outer pavilion surface and the bottom edge of the girdle, and the relatively large culet;

FIG. 6 is a top view of another gemstone in accordance with the present disclosure, the gemstone being an oval-cut gemstone cut to direct a first portion of light entering the gemstone through the table and the crown then back at the viewer and to direct a second portion of light entering the gemstone out of the gemstone toward the light-emission system to be captured by the light-emission system and emitted back into and back through the gemstone over a period of time;

FIG. 7 is a bottom view of the oval-cut gemstone of FIG. 6 showing the relatively large polished culet and a plurality of facets of the pavilion;

FIG. 8 is an elevation view of the oval-cut gemstone of FIG. 6 showing that the oval-cut gemstone includes, from top to bottom, the crown including an outer crown surface having a crown angle defined between the outer crown surface and a top edge of the girdle, the relatively thick polished girdle having a top edge and a bottom edge spaced apart from the top edge, the pavilion including an outer pavilion surface having a pavilion angle defined between the outer pavilion surface and the bottom edge of the girdle, and the relatively large culet;

FIG. 9 is an exploded perspective view of another embodiment of a light-emitting jewelry piece in accordance with the present disclosure showing that the light-emitting jewelry piece includes, from top to bottom, a gemstone, a light-emission system having a light-emitting band and a light-emitting disk configured to store and discharge light through the gemstone over time, a head arranged to support the gemstone and the light-emission system, and a mount arranged to secure the light-emitting jewelry piece to a person or personal adornment and further suggesting that the light-emitting band is configured to be positioned around the girdle of the gemstone with or without an airgap therebetween and the light-emitting disk is configured to mate with the culet of the gemstone;

FIG. 10 is a sectional and diagrammatic view of the light-emitting jewelry piece of FIG. 9 showing that the light-emission system includes the light-emitting band coupled to an external surface of the girdle of the gemstone and the light-emitting disk mated with the culet, the light-emitting band and the light-emitting disk configured to receive Ultra-Violet (UV) light or ambient light through the gemstone as suggested in FIG. 2 and store the UV light or ambient light for discharge through the gemstone over a period of time, and further showing that the head includes a gem retainer supporting the girdle of the gemstone, a culet retainer supporting the culet of the gemstone, and a plurality of prongs that extend between and interconnect the gem retainer and the culet support;

FIG. 11 is an exploded perspective view of another light-emitting jewelry piece in accordance with the present disclosure showing that the light-emitting jewelry piece includes, from top to bottom, a pear-cut gemstone, a light-emission system configured to be arranged around a portion of the pear-cut gemstone and to discharge light through the pear-cut gemstone, a head arranged to support the pear-cut gemstone and the light-emission system, and a mount arranged to secure the light-emitting jewelry piece to a person or personal adornment;

FIG. 12 is a top view of the pear-cut gemstone of FIG. 11 showing that the pear-cut gemstone is shaped to direct a first portion of light entering the gemstone through the crown and table then back at the viewer and to direct a second portion of light entering the gemstone out of the gemstone toward the light-emission system to be captured by the light-emission system and emitted back through the pear-cut gemstone over a period of time;

FIG. 13 is a bottom view of the pear-cut gemstone of FIG. 12 showing the relatively large polished culet of the gemstone and a plurality of facets of the pavilion; and FIG. 14 is an elevation view of the pear-cut gemstone of FIG. 12 showing that the pear-cut gemstone includes, from top to bottom, the crown including an outer crown surface having a crown angle defined between the outer crown surface and a top edge of the girdle, the relatively thick polished girdle having a top edge and a bottom edge spaced apart from the top edge, the pavilion including an outer pavilion surface having a pavilion angle defined between the outer pavilion surface and the bottom edge of the girdle, and the relatively large culet;

FIG. 15 is an exploded perspective view of another light-emitting jewelry piece in accordance with the present disclosure showing that the light-emitting jewelry piece includes, from top to bottom, a gemstone having a channel formed in a girdle of the gemstone, a light-emission system configured to be arranged around a portion of the gemstone and to discharge light through the gemstone, a head arranged to support the gemstone, and a mount arranged to secure the light-emitting jewelry piece to a person or personal adornment, and showing that the light-emission system includes a light-emitting band configured to extend into the channel formed in the girdle of the gemstone and a light-emitting disk configured to mate with a culet of the gemstone;

FIG. 16 is a sectional and diagrammatic view of the light-emitting jewelry piece of FIG. 15 showing that the channel formed in the girdle is V-shaped and the light-emitting band extends into the V-shaped channel of the girdle of the gemstone and further showing that the light-emitting disk is mated with the culet of the gemstone, the light-emitting band and the light-emitting disk configured to receive Ultra-Violet (UV) light or ambient light through the gemstone as suggested in FIG. 2 and store the UV light or ambient light for discharge through the gemstone over a period of time;

FIG. 17 is an elevation view of the gemstone of FIG. 15 showing that the gemstone includes, from top to bottom, the crown including an outer crown surface having a crown angle defined between the outer crown surface and a top edge of the girdle, the girdle having a top edge and a bottom edge spaced apart from the top edge and the channel located between the top and bottom edges, the pavilion including an outer pavilion surface having a pavilion angle defined between the outer pavilion surface and the bottom edge of the girdle, and the culet;

FIG. 18 is an exploded perspective view of yet another light-emitting jewelry piece in accordance with the present disclosure showing that the light-emitting jewelry piece includes, from top to bottom, a gemstone having a channel formed in a girdle of the gemstone and a colored wrap configured to be arranged around a portion of a pavilion of the gemstone, a light-emission system configured to be arranged around a portion of the gemstone and to discharge light through the gemstone, a head arranged to support the gemstone, and a mount arranged to secure the light-emitting jewelry piece to a person or personal adornment, and showing that the light-emission system includes a light-emitting band configured to extend into the channel formed in the girdle of the gemstone and a light-emitting disk configured to mate with a culet of the gemstone;

FIG. 19 is a sectional and diagrammatic view of the light-emitting jewelry piece of FIG. 18 showing that the colored wrap is coupled to a portion of the pavilion to vary an apparent color of the pavilion and further showing that the light-emitting band extends into the channel of the girdle of the gemstone and that the light-emitting disk is mated with the culet of the gemstone, the light-emitting band and the light-emitting disk configured to receive Ultra-Violet (UV) light or ambient light through the gemstone as suggested in FIG. 2 and store the UV light or ambient light for discharge through the gemstone over a period of time;

FIG. 20 is an exploded perspective view of yet another light-emitting jewelry piece in accordance with the present disclosure showing that the light-emitting jewelry piece includes, from top to bottom, a gemstone having a channel formed in a girdle of the gemstone, a light-emission system configured to be arranged around a portion of the gemstone and to discharge light through the gemstone, a head arranged to support the gemstone, and a mount arranged to secure the light-emitting jewelry piece to a person or personal adornment, and showing that the light-emission system includes a light-emitting band configured to extend into the channel formed in the girdle of the gemstone and a coned-shaped light-emitting pavilion plate configured to be arranged around a portion of the pavilion of the gemstone;

FIG. 21 is a sectional and diagrammatic view of the light-emitting jewelry piece of FIG. 20 showing that the light-emission system includes the light-emitting band that extends into the channel of the girdle of the gemstone and the light-emitting pavilion plate arranged around and spaced apart from the pavilion, the light-emitting band and the light-emitting pavilion plate configured to receive Ultra-Violet (UV) light or ambient light through the gemstone as suggested in FIG. 2 and store the UV light or ambient light for discharge through the gemstone over a period of time;

FIG. 21A is an enlarged sectional and diagrammatic view of a light-emitting jewelry piece similar to FIG. 21 showing another embodiment of a head for use with the light-emitting jewelry piece;

FIG. 22 is an elevation view of the gemstone of FIG. 20 showing that the gemstone includes, from top to bottom, the crown including an outer crown surface having a crown angle defined between the outer crown surface and a top edge of the girdle, the girdle having a top edge and a bottom edge spaced apart from the top edge and the channel located between the top and bottom edges, the pavilion including an outer pavilion surface having a pavilion angle defined between the outer pavilion surface and the bottom edge of the girdle, and the culet;

FIG. 23 is a diagrammatic view of a flowchart showing a method for making a light-emitting jewelry piece showing that the method includes providing the gemstone, the head, a light-emitting fluid, roughing an inside surface of the head, setting the gemstone in the head, applying the light-emitting fluid to the head, pavilion, and girdle, and heating the gemstone, head, and light-emitting fluid;

FIG. 24 is a diagrammatic view of a flowchart showing another method for making a light-emitting jewelry piece showing that the method includes providing the gemstone, a pusher rod, and the light-emitting fluid, roughing an top surface of the pusher rod, positioning the pusher rod in spaced apart relation to the culet, applying the light-emitting fluid to the culet and the top surface of the pusher rod, and heating the gemstone, the pusher rod, and the light-emitting fluid; and FIG. 25 is a diagrammatic view of a flowchart showing yet another method for making a light-emitting jewelry piece showing that the method includes providing the gemstone, a the pavilion plate, and the light-emitting fluid, roughing an inside surface of the pavilion plate, applying the light-emitting fluid to the inner surface of the pavilion plate, heating the pavilion plate and the light-emitting fluid, and coupling the pavilion plate to the head.

DETAILED DESCRIPTION

A light-emitting jewelry piece 10 in accordance with the present disclosure is shown in FIGS. 1-5. In the illustrative embodiment, the light-emitting jewelry piece 10 is a ring as shown in FIG. 1. Another embodiment of a light-emitting jewelry piece 110 in accordance with the present disclosure is shown in FIGS. 6-8. Another light-emitting jewelry piece 210 in accordance with the present disclosure is shown in FIGS. 9 and 10. Another light-emitting jewelry piece 310 in accordance with the present disclosure is shown in FIGS. 11-14. Yet another light-emitting jewelry piece 410 in accordance with the present disclosure is shown in FIGS. 15-17. Another light-emitting jewelry piece 510 in accordance with the present disclosure is shown in FIGS. 18 and 19. Yet another light-emitting jewelry piece 610 in accordance with the present disclosure is shown in FIGS. 20-22. Methods of making light-emitting jewelry pieces 410, 510, 610 is shown in FIGS. 23-25.

The light-emitting jewelry piece 10 includes a gemstone 12, a light-emission system 14, a head 16, and a mounting 18 as shown in FIG. 1. The gemstone 12 is a piece of material used to make an adornment such as, for example, a mineral, metal, rock, plastic, glass, colored gemstone, whether precious or non-precious, natural diamond, and lab-created diamond. The light-emission system 14 provides means for emitting light over time in response to receiving and storing energy 72 (e.g., UV light or ambient light) to cause visible light to be emitted through the gemstone 12. By emitting visible light over time, the light-emission system 14 illuminates the gemstone 12. Notably, the light-emission system 14 illuminates the gemstone 12 over time to allow a person to view the gemstone 12. Viewing may be maximized when the light-emitting jewelry piece 10 is in dusk and/or a dark environment. The head 16 interconnects the gemstone 12 to the mounting 18. The mounting 18 secures the light-emitting jewelry piece 10 to a person or a personal adornment. In other embodiments, the light-emitting jewelry piece 10 may be a pendant, bracelet, earrings, broach, or pin.

Illustratively, the gemstone 12 is a cushion-cut diamond as shown in FIGS. 1-5. The gemstone 12 includes a crown 20, a girdle 22, a pavilion 24, and a culet 26 as shown in FIGS. 1, 2, and 5. The crown 20 is located in spaced-apart relation above the pavilion 24 to locate the girdle 22 therebetween as shown in FIG. 5. The pavilion 24 is located between the girdle 22 and the culet 26. The culet 26 is a generally flat face (sometimes called a facet) on a bottom of the gemstone 12 as shown in FIGS. 4 and 5.

In the illustrative embodiment, the light-emission system 14 includes a light-emitting shell 60 as shown in FIGS. 1 and 2. The light-emitting shell 60 emits visible light through the gemstone 12 to illuminate the gemstone 12 in response to receiving and storing energy 72 (e.g., UV light or ambient light). As such, the gemstone 12 is illuminated by the light-emitting shell 60 until the stored energy 72 is depleted and, as a result, the gemstone 12 is illuminated and viewable in dusk and dark environments.

In operation, the light-emitting shell 60 and the gemstone 12 cooperate to capture light from light sources as suggested in FIG. 2. For example, the light-emitting shell 60 and the gemstone 12 cooperate to capture light from an upper light source 80 located above the crown 20 of the gemstone 12 as shown FIG. 2. The gemstone 12 is cut so that light transmitted through the crown 20 is communicated through the girdle 22, the pavilion 24, and the culet 26 to the light-emitting shell 60. As light 72 or other radiation enters the gemstone 12, a first portion of the light 72 is communicated back through the gemstone 12 to give the gemstone 12 brilliance and a second portion of the light 72 is communicated to the light-emitting shell 60 to charge the light-emitting shell 60.

The light 72 continuously charges the light-emitting shell 60 as suggested in FIG. 2. The light-emitting shell 60 continuously emits a portion of the stored light 72. The light-emitting shell 60 visually emits the stored light 72 through the gemstone's pavilion 24, girdle 22, and culet 26, and out of the table 54 and the crown 20 over time. As such, the gemstone 12 is illuminated by the light-emitting shell 60. Once ambient light decreases, such as after sun down or in a darkened room, the visually emitted light 72 may become more apparent to an observer.

The gemstone 12 may be one of a variety of sizes. In some embodiments, the gemstone 12 may range from a diameter of about 3.0 millimeters up to any diameter gemstone. In the illustrative embodiment, the gemstone 12 is about 0.65 carats in weight. Illustratively, the gemstone 12 has a width 28 and a height 30 as shown in FIG. 5. The width 28 of the illustrative gemstone 12 is 5.1 millimeters. The height 30 of the illustrative gemstone 12 is 3.15 millimeters. Dimensions of the gemstone 12 may be expressed by percentages of the width 28 of the gemstone 12. As an example, the height 30 of the illustrative gemstone 12 is 61.8 percent of the width 28 of the gemstone 12. As such, the illustrative gemstone 12 may be said to have a height 30 of 61.8 percent.

The girdle 22 defines the width 28 of the gemstone 12 as suggested in FIG. 5. In the illustrative embodiment, the girdle 22 has a width of about 5.1 millimeters. In other embodiments, the gemstone 12 may have a diameter of about 4.0 millimeters with a weight of about 0.25 carats, a diameter of about 4.4 millimeters with a weight of about 0.33 carats, a diameter of about 5.8 millimeters with a weight of about 0.75 carats, and a diameter of about 6.3 millimeters with a weight of about 1.0 carat for a round cut gemstone. The illustrative girdle 22 is highly polished. The girdle 22 is configured to mate with a shoulder support 64 of the light-emission system 14 as suggested in FIG. 2.

The girdle 22 includes a top edge 34 and a bottom edge 36 spaced apart from the top edge 34 as shown in FIG. 5. In the illustrative embodiment, the bottom edge 36 is spaced apart from the top edge 34 by a generally consistent distance around the circumference of the gemstone 12 to define a girdle height 38 as shown in FIG. 5. In some embodiments, the bottom edge 36 is spaced apart from the top edge 34 by a first distance in primary portions of the girdle 22 and by a second distance in secondary portions of the girdle 22. Each primary portion is positioned circumferentially between a pair of secondary portions. The first distance is greater than the second distance.

The girdle 22 has the relatively large girdle height 38 to increase a surface area engagement between the gemstone 12 and the shoulder support 64 of the light-emission system 14. In one example, the girdle height 38 is in a range of about or specifically 2 percent and about or specifically 15 percent of the width 28. In another example, the girdle height 38 is in a range of about or specifically 4 percent and about or specifically 8 percent of the width 28. In another example, the girdle height 38 is in a range of about or specifically 4.5 percent and about or specifically 8.5 percent of the width 28. In another example, the girdle height 38 is in a range of about or specifically 5 percent and about or specifically 7 percent of the width 28. In another example, the girdle height 38 is in a range of about or specifically 5.5 percent and about or specifically 7.5 percent of the width 28. In another example, the girdle height 38 is about or specifically 6.5 percent of the width 28. In another example, the girdle height 38 is about or specifically 6 percent of the width 28. In another example, the girdle height 38 is about or specifically 5.5 percent of the width 28. In the illustrative embodiment, the girdle height 38 is 6.2 percent of the width 28. In the illustrative embodiment, the girdle height 38 is 0.32 millimeters.

In some embodiments, the girdle 22 has a relatively large girdle height 38 when compared to an ideal cut diamond such as American Standard cut or the Tolkowsky Brilliant cut. The relatively large girdle height 38 may be about 10 percent to about 15 percent larger than an ideal cut diamond. In embodiments that include primary and secondary portions, the primary portions and the secondary portions may be about 10 percent to about 15 percent larger than the primary and secondary portions of an ideal cut diamond respectively.

The crown 20 extends from the girdle 22 away from the pavilion 24 as shown in FIG. 5. An outer crown surface 40 of the crown 20 and the top edge 34 of the girdle 22 define a crown angle 42 as shown in FIG. 5. Sometimes, the crown angle 42 may be referred to as being defined between facets of the crown 20 and a girdle plane. The crown angle 42 may also be referred to as being defined by a leading edge of the table 54 and a top leading edge of the girdle 22. In one example, the crown angle 42 is in a range of about or specifically 36 degrees to about or specifically 50 degrees. In another example, the crown angle 42 is in a range of about or specifically 39 degrees to about or specifically 46 degrees. In another example, the crown angle 42 is in a range of about or specifically 39 degrees to about or specifically 45 degrees. In another example, the crown angle 42 is in a range of about or specifically 39 degrees to about or specifically 44 degrees. In another example, the crown angle 42 is in a range of about or specifically 40 degrees to about or specifically 46 degrees. In another example, the crown angle 42 is in a range of about or specifically 41 degrees to about or specifically 46 degrees. In another example, the crown angle 42 is in a range of about or specifically 44 degrees to about or specifically 46 degrees. In another example, the crown angle 42 is in a range of about or specifically 45 degrees to about or specifically 46 degrees.

In another example, the crown angle 42 is in a range of about or specifically 36 degrees to about or specifically 45 degrees. In another example, the crown angle 42 is in a range of about or specifically 38 degrees to about or specifically 42 degrees. In another example, the crown angle 42 is in a range of about or specifically 39 degrees to about or specifically 41 degrees. In another example, the crown angle 42 is about or specifically 40 degrees. In the illustrative embodiment, the crown angle 42 is 39.5 degrees.

The crown 20 includes a crown height 44 defined between a table 54 of the gemstone 12 and the top edge 34 of the girdle 22 as shown in FIG. 5. In one example, the crown height 44 is in a range of about or specifically 16 percent and about or specifically 20 percent of the width 28 of the gemstone 12. In another example, the crown height 44 is in a range of about or specifically 17 percent and about or specifically 19 percent of the width 28. In another example, the crown height 44 is about or specifically 18 percent of the width 28. In another example, the crown height 44 is about or specifically 16 percent of the width 28. In the illustrative embodiment, the crown height 44 is 17.8 percent of the width 28. In the illustrative embodiment, the crown height 44 is 0.91 millimeters.

In another example, the crown height 44 is in a range of about or specifically 15 percent and about or specifically 19 percent of the width 28. In another example, the crown height 44 is in a range of about or specifically 16 percent and about or specifically 18 percent of the width 28.

The pavilion 24 extends between and interconnects the girdle 22 and the culet 26 as shown in FIG. 5. The pavilion 24 includes a plurality of outer pavilion surfaces 46 (sometimes called facets) that extend between and interconnect the girdle 22 and the culet 26. A pavilion angle 48 is defined between each outer pavilion surface 32 of the pavilion 24 and the bottom edge 36 of the girdle 22 as shown in FIG. 5.

In one example, the pavilion angle 48 is in a range of about or specifically 36 degrees to about or specifically 50 degrees. In another example, the pavilion angle 48 is in a range of about or specifically 39 degrees to about or specifically 45 degrees. In another example, the pavilion angle 48 is in a range of about or specifically 40 degrees to about or specifically 45 degrees. In another example, the pavilion angle 48 is in a range of about or specifically 41 degrees to about or specifically 45 degrees. In another example, the pavilion angle 48 is in a range of about or specifically 42 degrees to about or specifically 45 degrees. In another example, the pavilion angle 48 is in a range of about or specifically 43 degrees to about or specifically 45 degrees.

In another example, the pavilion angle 48 is in a range of about or specifically 39 degrees to about or specifically 44 degrees. In another example, the pavilion angle 48 is in a range of about or specifically 39 degrees to about or specifically 43 degrees. In another example, the pavilion angle 48 is in a range of about or specifically 39 degrees to about or specifically 42 degrees. In another example, the pavilion angle 48 is in a range of about or specifically 39 degrees to about or specifically 40 degrees.

In another example, the pavilion angle 48 is in a range of about or specifically 36 degrees to about or specifically 45 degrees. In another example, the pavilion angle 48 is in a range of about or specifically 38 degrees to about or specifically 42 degrees. In another example, the pavilion angle 48 is in a range of about or specifically 39 degrees to about or specifically 41 degrees. In another example, the pavilion angle 48 is about or specifically 40 degrees. In the illustrative embodiment, the pavilion angle 48 is 39.7 degrees.

The pavilion 24 includes a pavilion depth 50 defined between the bottom edge 36 of the girdle 22 and the culet 26 as shown in FIG. 5. In one example, the pavilion depth 50 is in a range of about or specifically 36 percent and about or specifically 40 percent of the width 28. In another example, the pavilion depth 50 is in a range of about or specifically 37 percent and about or specifically 39 percent of the width 28. In another example, the pavilion depth 50 is about or specifically 38.5 percent of the width 28. In another example, the pavilion depth 50 is about or specifically 38 percent of the width 28. In the illustrative embodiment, the pavilion depth 50 is 37.5 percent of the width 28. In the illustrative embodiment, the pavilion depth 50 is 1.91 millimeters.

In another example, the pavilion depth 50 is in a range of about or specifically 37 percent and about or specifically 41 percent of the width 28. In another example, the pavilion depth 50 is in a range of about or specifically 38 percent and about or specifically 40 percent of the width 28.

The culet 26 is configured to mate with the light-emission system 14 as suggested in FIG. 2. The culet 26 is relatively oversized to increase a surface area engagement between the gemstone 12 and the light-emission system 14 for greater light absorption from the light-emission system 14 into the gemstone 12. In some embodiments, the culet 26 mates with a culet cover 66 included in the light-emission system 14 as suggested in FIG. 2. In other embodiments, the culet 26 mates with a light-emitting disk 282 included in a light-emission system 214 as suggested in FIGS. 9 and 10.

The culet 26 includes a culet width 52 (sometimes called a culet diameter) as shown in FIG. 5. In one example, the culet width 52 is in a range of about or specifically 7.5 percent and about or specifically 22 percent of the width 28 of the gemstone 12. In another example, the culet width 52 is in a range of about or specifically 9 percent and about or specifically 13 percent of the width 28. In another example, the culet width 52 is in a range of about or specifically 10 percent and about or specifically 12 percent of the width 28. In another example, the culet width 52 is about or specifically 11 percent of the width 28. In another example, the culet width 52 is 11.8 percent of the width 28. In the illustrative embodiment, the culet width 52 is 0.60 millimeters.

In another example, the culet width 52 is in a range of about or specifically 18 percent and about or specifically 22 percent of the width 28. In another example, the culet width 52 is in a range of about or specifically 19 percent and about or specifically 20 percent of the width 28. In another example, the culet width 52 is about or specifically 20 percent of the width 28. In another example, the culet width 52 is about or specifically 18 percent of the width 28.

The culet 26 may be, for example, oversized when compared to an ideal cut diamond such as the American Standard cut or the Tolkowsky Brilliant cut. The culet 26 may be about 10 percent to about 15 percent larger than a culet of an ideal cut diamond. In some embodiments, the culet 26 is about 13 percent larger than a culet of an ideal cut diamond. In the illustrative embodiment, the culet 26 is off-center. Illustratively, the culet 26 is off-center by 1.8 percent. The culet 26 may also be highly polished.

The gemstone 12 further includes a table 54 including a table width 56 as shown in FIG. 5. In one example, the table width 56 is in a range of about or specifically 45 percent and about or specifically 65 percent of the width 28 of the gemstone 12. In another example, the table width 56 is in a range of about or specifically 50 percent and about or specifically 60 percent of the width 28. In another example, the table width 56 is in a range of about or specifically 51.5 percent and about or specifically 59 percent of the width 28. In another example, the table width 56 is in a range of about or specifically 54 percent and about or specifically 56.5 percent of the width 28. In another example, the table width 56 is about or specifically 55 percent of the width 28. In another example, the table width 56 is 61 percent of the width 28. In the illustrative embodiment, the table width 56 is 56.2 percent of the width 28. In the illustrative embodiment, the table width 56 is 2.87 millimeters. The illustrative table 54 is off-center by 0.12 millimeters.

The light-emission system 14 emits light over a period of time to illuminate the gemstone 12 as shown in FIG. 2. In one example, the light-emission system 14 may emit a green light. In another example, the light-emission system 14 may emit a blue light. In still yet another example, the light-emission system 14 may emit any other suitable color of light. In other embodiments, the light-emission system 14 emits a plurality of colors of light.

Illustratively, the light-emitting shell 60 is made from a photo-luminescent material. In some embodiments, the light-emitting shell 60 includes plastics material. In some embodiments, the light-emitting shell 60 includes photo-luminescent material and plastics materials. The light-emitting shell 60 may be rotocast or injection molded from the photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting shell 60 has a thickness of about 0.5 millimeters.

The light-emitting shell 60 is coupled to the head 16 in a fixed position as suggested in FIG. 1. The light-emitting shell 60 is configured to couple to the gemstone 12 in such a way as to minimize space between the gemstone 12 and the light-emitting shell 60 so that ingress of debris such as, for example, moisture, dirt, or condensation build up between the gemstone 12 and the light-emitting shell 60 is minimized. In the illustrative embodiment, the light-emitting shell 60 is coupled to external surfaces of the gemstone 12.

Space between the gemstone 12 and the light-emitting shell 60 may be minimized through one or more manufacturing techniques. In one example, the light-emitting shell 60 is injection molded. In this example, the gemstone 12 is coupled to a portion of the mold using releasable sealant. During injection molding, molten plastics materials flow around the gemstone 12 into the mold chamber formed between the gemstone 12 and the mold. As a result, space between the gemstone 12 and the light-emitting shell 60 is minimized and the exact angle of the gemstone 12 in relation to the light-emitting shell 60 is provided. The gemstone 12 may be removed from the mold using a release pin which pushes the gemstone 12 away from the mold after molding. In addition, a gasket may be located between the girdle 22 of the gemstone 12 and the mold to minimize flashing of plastic material around the crown 20 of the gemstone 12.

The light-emitting shell 60 includes a body 62, the shoulder support 64, and the culet cover 66 as shown in FIG. 2. The body 62 engages the pavilion 24 to absorb and emit light through the gemstone 12. The shoulder support 64 engages the girdle 22 and couples the girdle 22 with the head 16. The culet cover 66 engages the culet 26 and couples the gemstone 12 with the head 16.

The body 62 is formed from a plurality of sidewalls 68. The sidewalls 68 are about parallel with the outer pavilion surfaces 32 included in the pavilion 24 of the gemstone 12. The sidewalls 68 engage with and mate with the pavilion 24 of the gemstone 12. Illustratively, the sidewalls 68 have a thickness of about 0.5 millimeters.

The plurality of sidewalls 68 cooperate to form a gemstone-receiver aperture 70 that extends into the light-emitting shell 60. The gemstone 12 is received in the gemstone-receiver aperture 70 to cause the sidewalls 68 of the body 62 to engage the outer pavilion surfaces 32 of the pavilion 24. In the illustrative embodiment, a sealant is located between the gemstone 12 and the body 62 to couple together external surfaces of the gemstone 12 and the body 62. The sealant blocks debris from entering the gemstone-receiver aperture 70 between the gemstone 12 and the body 62.

The shoulder support 64 extends radially outward from the body 62 away from the gemstone 12 as shown in FIG. 2. The shoulder support 64 extends around the body 62 circumferentially. The shoulder support 64 engages the girdle 22 of the gemstone 12 to couple the light-emitting shell 60 with the gemstone 12. In the illustrative embodiment, the shoulder support 64 has a thickness that is about equal to the thickness of the girdle 22. As such, the shoulder support 64 extends upwardly away from the body 62 to the top edge 34 of the girdle 22. In other embodiments, the shoulder support 64 has a thickness that is less than the thickness of the girdle 22. As a result, the shoulder support 64 may have an inverted L-shape.

The culet cover 66 extends downwardly from the body 62 away from the gemstone 12 as shown in FIGS. 1 and 2. The culet cover 66 is positioned between the head 16 and the culet 26 to support the gemstone 12. The culet cover 66 is received in a space formed in the head 16 to block movement of the light-emitting shell 60 away from the head 16. If the light-emitting jewelry piece 10 collides with a hard surface, the culet cover 66 blocks the head 16 from striking the culet 26 directly.

The head 16 includes a gem retainer 74, a culet support 76, and a plurality of prongs 78 as shown in FIG. 1. The gem retainer 74 mates with the girdle 22 of the gemstone 12 and the shoulder support 64 of the light-emitting shell 60 to retain the light-emitting shell 60 between the gemstone 12 and the head 16. The culet support 76 is located in spaced-apart relation to the gem retainer 74 and mates with the culet 26 of the gemstone 12 and retains the culet cover 66 of the light-emitting shell 60 between the gemstone 12 and the head 16. The prongs 78 extend between and interconnect the gem retainer 74 and the culet support 76.

In some embodiments, the light-emission system 14 includes at least one light source powered through radioluminescence. In some embodiments, the at least one light source is powered by tritium-illumination. In some embodiments, the light-emitting jewelry piece 10 is called a jewelry piece 10. In some embodiments, the light emission systems 114, 214, and 314 include at least one light source powered through radioluminescense.

Reference is hereby made to U.S. patent application Ser. No. 14/487,969 filed Sep. 16, 2014 and entitled LIGHT EMITTING JEWELRY for disclosure relating to gemstones, light-emission systems, and heads, which application is hereby incorporated in its entirety herein.

Another light-emitting jewelry piece 110 in accordance with the present disclosure is shown in FIGS. 6-8. The light-emitting jewelry piece 110 includes a gemstone 112, the light-emission system 14, the head 16, and the mounting 18. The gemstone 112 is a piece of material used to make an adornment such as, for example, a mineral, metal, rock, plastic, glass, colored gemstone, whether precious or non-precious, natural diamond, and lab-created diamond. The light-emission system 14 is configured to receive an oval-cut gemstone and is configured to provide means for emitting light over time to cause visible light to be emitted through the gemstone 12 and to be viewed by a person when the light-emitting jewelry piece 110 is in a dusk to dark environment. The head 16 interconnects the gemstone 112 to the mounting 18. The mounting 18 secures the light-emitting jewelry piece 110 to a person or a personal adornment.

Illustratively, the gemstone 112 is an oval-cut diamond as shown in FIGS. 6 and 7. The gemstone 112 includes a crown 120, a girdle 122, a pavilion 124, and a culet 126 as shown in FIG. 8.

Illustratively, the gemstone 112 has a width 128, a length 132, and a height 130 as shown in FIGS. 6 and 8. The width 128 of the illustrative gemstone 112 is 4.96 millimeters and the length 132 is 6.47 millimeters. The height 130 of the illustrative gemstone 112 is 3.06 millimeters. Dimensions of the gemstone 112 may be expressed by percentages of the width 128 of the gemstone 112. As an example, the height 130 of the illustrative gemstone 112 is 61.7 percent of the width 128 of the gemstone 112. As such, the illustrative gemstone 112 may be said to have a height 130 of 61.7 percent. In the illustrative embodiment, the gemstone 112 is about 0.74 carats in weight.

The oval-cut gemstone 112 includes a length-to-width ratio as suggested in FIG. 6. In one example, the length-to-width ratio is between about 1.0 and about 1.5. In the illustrative embodiment, the length-to-width ratio is about 1.30.

The girdle 122 has a width equal to the width of the gemstone 112 and a length equal to the length of the gemstone 112 as shown in FIG. 6. The illustrative girdle 122 is highly polished. The girdle 122 is configured to mate with the light-emission system 14.

The girdle 122 includes a top edge 134 and a bottom edge 136 spaced apart from the top edge 134 as shown in FIG. 8. In the illustrative embodiment, the bottom edge 136 is spaced apart from the top edge 134 by a generally consistent distance around the circumference of the gemstone 112 to define a girdle height 138 as shown in FIG. 8. In some embodiments, the bottom edge 136 is spaced apart from the top edge 134 by a first distance in primary portions of the girdle 122 and by a second distance in secondary portions of the girdle 122. Each primary portion is positioned circumferentially between a pair of secondary portions. The first distance is greater than the second distance.

The girdle 122 has the relatively large girdle height 138 to increase a surface area engagement between the gemstone 112 and the light-emission system 14 as suggested in FIG. 8. In one example, the girdle height 138 is in a range of about or specifically 2 percent and about or specifically 15 percent of the width 128 of the gemstone 112. In another example, the girdle height 138 is in a range of about or specifically 4.5 percent and about or specifically 8.5 percent of the width 128. In another example, the girdle height 138 is in a range of about or specifically 5.5 percent and about or specifically 7.5 percent of the width 128. In another example, the girdle height 138 is about or specifically 6.5 percent of the width 128. In the illustrative embodiment, the girdle height 138 is 6.7 percent of the width 128. In the illustrative embodiment, the girdle height 138 is 0.33 millimeters.

In another example, the girdle height 138 is in a range of about or specifically 4 percent and about or specifically 8 percent of the width 128. In another example, the girdle height 138 is in a range of about or specifically 5 percent and about or specifically 7 percent of the width 128. In another example, the girdle height 138 is about or specifically 6 percent of the width 128.

The crown 120 extends from the girdle 122 away from the pavilion 124 as shown in FIG. 8. An outer crown surface 140 of the crown 120 and the top edge 134 of the girdle 122 define a crown angle 142 as shown in FIG. 8. In one example, the crown angle 142 is in a range of about or specifically 36 degrees to about or specifically 50 degrees. In another example, the crown angle 142 is in a range of about or specifically 39 degrees to about or specifically 46 degrees. In another example, the crown angle 142 is in a range of about or specifically 39 degrees to about or specifically 45 degrees. In another example, the crown angle 142 is in a range of about or specifically 39 degrees to about or specifically 44 degrees. In another example, the crown angle 142 is in a range of about or specifically 40 degrees to about or specifically 46 degrees. In another example, the crown angle 142 is in a range of about or specifically 41 degrees to about or specifically 46 degrees. In another example, the crown angle 142 is in a range of about or specifically 44 degrees to about or specifically 46 degrees. In another example, the crown angle 142 is in a range of about or specifically 45 degrees to about or specifically 46 degrees.

In another example, the crown angle 142 is in a range of about or specifically 36 degrees to about or specifically 45 degrees. In another example, the crown angle 142 is in a range of about or specifically 38 degrees to about or specifically 42 degrees. In another example, the crown angle 142 is in a range of about or specifically 39 degrees to about or specifically 41 degrees. In another example, the crown angle 142 is about or specifically 40 degrees. In the illustrative embodiment, the crown angle 142 is 39.4 degrees.

The crown 120 includes a crown height 144 defined between a table 154 of the gemstone 112 and the top edge 134 of the girdle 122 as shown in FIG. 8. In one example, the crown height 144 is in a range of about or specifically 15 percent and about or specifically 19 percent of the width 128 of the gemstone 112. In another example, the crown height 144 is in a range of about or specifically 16 percent and about or specifically 18 percent of the width 128. In another example, the crown height 144 is about or specifically 17 percent of the width 128. In the illustrative embodiment, the crown height 144 is 16.5 percent of the width 128. In the illustrative embodiment, the crown height 144 is 0.82 millimeters.

In another example, the crown height 144 is in a range of about or specifically 16 percent and about or specifically 20 percent of the width 128. In another example, the crown height 144 is in a range of about or specifically 17 percent and about or specifically 19 percent of the width 128. In another example, the crown height 144 is about or specifically 18 percent of the width 128.

The pavilion 124 extends between and interconnects the girdle 122 and the culet 126 as shown in FIG. 8. The pavilion 124 includes a plurality of outer pavilion surfaces 146 that extend between and interconnect the girdle 122 and the culet 126. A pavilion angle 148 is defined between each outer pavilion surface 146 of the pavilion 124 and the bottom edge 136 of the girdle 122.

In one example, the pavilion angle 148 is in a range of about or specifically 36 degrees to about or specifically 50 degrees. In another example, the pavilion angle 148 is in a range of about or specifically 39 degrees to about or specifically 45 degrees. In another example, the pavilion angle 148 is in a range of about or specifically 40 degrees to about or specifically 45 degrees. In another example, the pavilion angle 148 is in a range of about or specifically 41 degrees to about or specifically 45 degrees. In another example, the pavilion angle 148 is in a range of about or specifically 42 degrees to about or specifically 45 degrees. In another example, the pavilion angle 148 is in a range of about or specifically 43 degrees to about or specifically 45 degrees.

In another example, the pavilion angle 148 is in a range of about or specifically 39 degrees to about or specifically 44 degrees. In another example, the pavilion angle 148 is in a range of about or specifically 39 degrees to about or specifically 43 degrees. In another example, the pavilion angle 148 is in a range of about or specifically 39 degrees to about or specifically 42 degrees. In another example, the pavilion angle 148 is in a range of about or specifically 39 degrees to about or specifically 40 degrees.

In another example, the pavilion angle 148 is in a range of about or specifically 36 degrees to about or specifically 45 degrees. In another example, the pavilion angle 148 is in a range of about or specifically 38 degrees to about or specifically 42 degrees. In another example, the pavilion angle 148 is in a range of about or specifically 39 degrees to about or specifically 41 degrees. In another example, the pavilion angle 148 is about or specifically 40 degrees. In the illustrative embodiment, the pavilion angle 148 is 39.2 degrees.

The pavilion 124 includes a pavilion depth 150 defined between the bottom edge 136 of the girdle 122 and the culet 126 as shown in FIG. 8. In one example, the pavilion depth 150 is in a range of about or specifically 37 percent and about or specifically 41 percent of the width 128 of the gemstone. In another example, the pavilion depth 150 is in a range of about or specifically 38 percent and about or specifically 40 percent of the width 128. In another example, the pavilion depth 150 is about or specifically 39 percent of the width 128. In the illustrative embodiment, the pavilion depth 150 is 38.3 percent of the width 128. In the illustrative embodiment, the pavilion depth 150 is 1.90 millimeters.

In another example, the pavilion depth 150 is in a range of about or specifically 38 percent and about or specifically 42 percent of the width 128 of the gemstone. In another example, the pavilion depth 150 is in a range of about or specifically 39 percent and about or specifically 41 percent of the width 128. In another example, the pavilion depth 150 is about or specifically 40 percent of the width 128.

The culet 126 is configured to mate with the light-emission system 14 as suggested in FIG. 2. The culet 126 is relatively oversized to increase a surface area engagement between the gemstone 112 and the light-emission system 14 for greater light absorption from the light-emission system 14 into the gemstone 112.

The culet 126 includes a culet width 152 (sometimes called culet diameter) as shown in FIG. 8. In one example, the culet width 152 is in a range of about or specifically 7.5 percent and about or specifically 20 percent of the width 128 of the gemstone 112. In another example, the culet width 152 is in a range of about or specifically 18 percent and about or specifically 22 percent of the width 128. In another example, the culet width 152 is in a range of about or specifically 19 percent and about or specifically 21 percent of the width 128. In another example, the culet width 152 is about or specifically 20 percent of the width 128. In the illustrative embodiment, the culet width 152 is about or specifically 18 percent of the width 128. In the illustrative embodiment, the culet width 152 is 0.99 millimeters.

In another example, the culet width 152 is in a range of about or specifically 9 percent and about or specifically 13 percent of the width 128. In another example, the culet width 152 is in a range of about or specifically 10 percent and about or specifically 12 percent of the width 128. In another example, the culet width 152 is about or specifically 11 percent of the width 128.

In the illustrative embodiment, the culet 126 is off-center. Illustratively, the culet 126 is off-center by 2.8 percent. The culet 126 may also be highly polished.

The gemstone 112 further includes a table 154 including a table width 156 as shown in FIG. 8. In one example, the table width 156 is in a range of about or specifically 45 percent and about or specifically 65 percent of the width 128 of the gemstone 112. In another example, the table width 156 is in a range of about or specifically 59 percent and about or specifically 63 percent of the width 128. In another example, the table width 156 is in a range of about or specifically 61 percent and about or specifically 62 percent of the width 128. In another example, the table width 156 is about or specifically 61.5 percent of the width 128. In the illustrative embodiment, the table width 56 is 61.1 percent of the width 128. In the illustrative embodiment, the table width 156 is 3.03 millimeters. The illustrative table 154 is off-center by 0.06 millimeters.

In another example, the table width 156 is in a range of about or specifically 51.5 percent and about or specifically 59 percent of the width 128. In another example, the table width 156 is in a range of about or specifically 54 percent and about or specifically 56.5 percent of the width 128. In another example, the table width 156 is about or specifically 55.25 percent of the width 128.

Another light-emitting jewelry piece 210 in accordance with the present disclosure is shown in FIGS. 9 and 10. The light-emitting jewelry piece 210 includes a gemstone 212, a light-emission system 214, a head 216, and the mounting 18. The gemstone 212 is a piece of material used to make an adornment such as, for example, a mineral, metal, rock, plastic, glass, colored gemstone, whether precious or non-precious, natural diamond, and lab-created diamond. The light-emission system 214 is configured to provide means for emitting light over time to cause visible light to be emitted through the gemstone 212. As such, the gemstone 212 may be viewed by a person when the light-emitting jewelry piece 210 is in a dusk to dark environment. The head 216 interconnects the gemstone 212 to the mounting 18. The mounting 18 secures the light-emitting jewelry piece 210 to a person or a personal adornment.

Illustratively, the gemstone 212 is a round-cut diamond. The gemstone 212 includes a crown 220, a girdle 222, a pavilion 224, and a culet 226 as shown in FIGS. 9 and 10.

The light-emission system 214 emits light over a period of time to illuminate the gemstone 212 as suggested in FIG. 10. In one example, the light-emission system 214 may emit a green light. In another example, the light-emission system 214 may emit a blue light. In still yet another example, the light-emission system 214 may emit any other suitable color of light. In other embodiments, the light-emission system 214 emits a plurality of colors of light.

The light-emission system 214 includes a light-emitting band 280 and a light-emitting disk 282 as shown in FIGS. 9 and 10. The light-emitting band 280 and the light-emitting disk 282 emit visible light through the gemstone 212 to illuminate the gemstone 212 in response to receiving and storing energy 72 (e.g., UV light or ambient light). As such, the gemstone 212 is illuminated in dark environments by the light-emission system 214 until the stored energy 72 is depleted. Light-emitting band 280 is spaced apart from light-emitting disk 282 relative to gemstone 212 to allow light to enter pavilion 224 between light-emitting band 280 and light-emitting disk 282. As a result, luster and brilliance in the gemstone in a bright or daylight environment may be maximized.

The light-emitting band 280 includes an upper portion 290 that extends about the girdle 222 of the gemstone 212 as shown in FIG. 10. In some examples, the light-emitting band 280 includes a lower portion 292 configured to extend around a portion of the pavilion 224. In the illustrative embodiment, the lower portion 292 of the light-emitting band 280 extends away from the upper portion 290 by a band angle and the band angle is about equal to the pavilion angle 248. In the illustrative embodiment, the lower portion 292 extends from upper portion 290 and terminates at a point on a portion of pavilion 224 so that the light-emitting band 280 is spaced apart from culet 226 relative to gemstone 212 to allow ambient light to enter gemstone 212 though pavilion 224 therebetween.

The upper portion 290 of light-emitting band 280 includes an upper surface 294 and a lower surface 296. Upper surface 294 of upper portion 290 is arranged to face upwardly away from light-emitting band 280. Lower surface 296 of upper portion 290 is arranged to face downwardly toward lower portion 292 of light-emitting band 280. Upper portion 290 of light-emitting band 280 is configured to engage girdle 222 and extend around gemstone 212.

The lower portion 292 of light-emitting band 280 includes an upper surface 298 and a lower surface 300. Upper surface 298 of lower portion 292 is arranged to face upwardly away from lower portion 292 of light-emitting band 280. Upper surface 298 of lower portion 292 is configured to engage lower surface 296 of upper portion 290. Lower surface 300 of lower portion 292 is arranged to face downwardly away from toward lower portion 292 of light-emitting band 280. Lower portion 292 of light-emitting band 280 is configured to engage pavilion 224 and extend around pavilion 224 and terminate in spaced-apart relation to culet cover 226.

The light-emitting band 280 is formed to include a gemstone-receiver aperture 270 sized to receive the gemstone 212 as shown in FIG. 9. The light-emitting band 280 is coupled to an exterior surface of the girdle 222. In the illustrative embodiment, the light-emitting band 280 is coupled to an exterior surface of the pavilion 224. Illustratively, the light-emitting band 280 is made from a photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting band 280 has a thickness of about 0.5 millimeters. In some embodiments, the light-emitting band 280 includes plastics material.

The light-emitting disk 282 illustratively forms a solid cylinder configured to mate with the culet 226 of the gemstone 212 as shown in FIG. 10. A top surface 283 of light-emitting disk 282 is coupled to an exterior surface 227 of the culet 226. Illustratively, the light-emitting disk 282 is made from a photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting disk 282 has a thickness of about 0.5 millimeters. In some embodiments, the light-emitting disk 282 includes plastics material.

The head 216 includes a gem retainer 274, a culet support 276, and a plurality of prongs 278 as shown in FIGS. 9 and 10. The gem retainer 274 mates with the girdle 222 of the gemstone 212 and the light-emitting band 280 to retain the light-emitting band 280 between the gemstone 212 and the head 216 as shown in FIG. 10. In one example, the gem retainer 274 covers a top surface of the light-emitting band blocking a user from seeing light emitted directly from the top surface of the light-emitting band and directing that light back into the gemstone. The culet support 276 is located in spaced-apart relation to the gem retainer 274 and mates with the light-emitting disk 282 to retain the light-emitting disk 282 between the culet 226 of the gemstone 212 and the head 216 as suggested in FIG. 10. The prongs 278 extend between and interconnect the gem retainer 274 and the culet support 276.

Another light-emitting jewelry piece 310 in accordance with the present disclosure is shown in FIGS. 11-14. The light-emitting jewelry piece 310 includes a gemstone 312, a light-emission system 314, a head 316, and the mounting 18. The gemstone 312 is a piece of material used to make an adornment such as, for example, a mineral, metal, rock, plastic, glass, colored gemstone, whether precious or non-precious, natural diamond, and lab-created diamond. The light-emission system 314 is configured to receive a pear-cut gemstone and is configured to provide means for emitting light over time to cause visible light to be emitted through the gemstone 312 and to be viewed by a person when the light-emitting jewelry piece 310 is in a dusk to dark environment. The head 316 interconnects the gemstone 312 to the mounting 18. The mounting 18 secures the light-emitting jewelry piece 310 to a person or a personal adornment.

Illustratively, the gemstone 312 is a pear-cut diamond as shown in FIG. 12. The gemstone 312 includes a crown 320, a girdle 322, a pavilion 324, and a culet 326 as shown in FIG. 14.

Illustratively, the gemstone 312 has a width 328, a length 332, and a height 330 as shown in FIGS. 12-14. The width 328 of the illustrative gemstone 312 is 4.57 millimeters and the length 332 is 6.36 millimeters. The height 330 of the illustrative gemstone 312 is 3.15 millimeters. Dimensions of the gemstone 312 may be expressed by percentages of the width 328 of the gemstone 312. As an example, the height 330 of the illustrative gemstone 312 is 68.9 percent of the width 328 of the gemstone 312. As such, the illustrative gemstone 312 may be said to have a height 330 of 68.9 percent. In the illustrative embodiment, the gemstone 312 is about 0.63 carats in weight.

The pear-cut gemstone 312 includes a length-to-width ratio as suggested in FIG. 12. In one example, the length-to-width ratio is between about 1.0 and about 1.5. In the illustrative embodiment, the length-to-width ratio is about 1.39.

The girdle 322 is configured to mate with the light-emission system 314. The girdle 322 has a width equal to the width of the gemstone 312 and a length equal to the length of the gemstone 312 as shown in FIG. 12. The illustrative girdle 322 is highly polished.

The girdle 322 includes a top edge 334 and a bottom edge 336 spaced apart from the top edge 334 as shown in FIG. 14. In the illustrative embodiment, the bottom edge 336 is spaced apart from the top edge 334 by a generally consistent distance around the circumference of the gemstone 312 to define a girdle height 338 as shown in FIG. 14. In some embodiments, the bottom edge 336 is spaced apart from the top edge 334 by a first distance in primary portions of the girdle 322 and by a second distance in secondary portions of the girdle 322. Each primary portion is positioned circumferentially between a pair of secondary portions. The first distance is greater than the second distance.

The girdle 322 has the relatively large girdle height 338 to increase a surface area engagement between the gemstone 312 and the light-emission system 314 as suggested in FIG. 14. In one example, the girdle height 338 is in a range of about or specifically 2 percent and about or specifically 15 percent of the width 328 of the gemstone 312. In another example, the girdle height 338 is in a range of about or specifically 4.5 percent and about or specifically 8.5 percent of the width 328. In another example, the girdle height 338 is in a range of about or specifically 5.5 percent and about or specifically 7.5 percent of the width 328. In another example, the girdle height 338 is in a range of about or specifically 6.9 percent and about or specifically 7.5 percent of the width 328. In another example, the girdle height 338 is about or specifically 7.2 percent of the width 328. In the illustrative embodiment, the girdle height 338 is 0.33 millimeters.

In another example, the girdle height 338 is in a range of about or specifically 4 percent and about or specifically 8 percent of the width 328. In another example, the girdle height 338 is in a range of about or specifically 6 percent and about or specifically 8 percent of the width 328. In another example, the girdle height 338 is about or specifically 7 percent of the width 328.

The crown 320 extends from the girdle 322 away from the pavilion 324 as shown in FIG. 14. An outer crown surface 340 of the crown 320 and the top edge 334 of the girdle 322 define a crown angle 342. In one example, the crown angle 342 is in a range of about or specifically 36 degrees to about or specifically 50 degrees. In another example, the crown angle 342 is in a range of about or specifically 39 degrees to about or specifically 46 degrees. In another example, the crown angle 342 is in a range of about or specifically 39 degrees to about or specifically 45 degrees. In another example, the crown angle 342 is in a range of about or specifically 39 degrees to about or specifically 44 degrees. In another example, the crown angle 342 is in a range of about or specifically 40 degrees to about or specifically 46 degrees. In another example, the crown angle 342 is in a range of about or specifically 41 degrees to about or specifically 46 degrees. In another example, the crown angle 342 is in a range of about or specifically 44 degrees to about or specifically 46 degrees. In another example, the crown angle 342 is in a range of about or specifically 45 degrees to about or specifically 46 degrees.

In another example, the crown angle 342 is in a range of about or specifically 36 degrees to about or specifically 45 degrees. In another example, the crown angle 342 is in a range of about or specifically 38 degrees to about or specifically 42 degrees. In another example, the crown angle 342 is in a range of about or specifically 39 degrees to about or specifically 41 degrees. In another example, the crown angle 342 is about or specifically 40 degrees. In the illustrative embodiment, the crown angle 342 is 40.1 degrees.

The crown 320 includes a crown height 344 defined between a table 354 of the gemstone 312 and the top edge 334 of the girdle 322 as shown in FIG. 14. In one example, the crown height 344 is in a range of about or specifically 15 percent and about or specifically 20 percent of the width 328 of the gemstone 312. In another example, the crown height 344 is in a range of about or specifically 17 percent and about or specifically 19 percent of the width 328. In another example, the crown height 344 is about or specifically 19 percent of the width 328. In the illustrative embodiment, the crown height 344 is 18.6 percent of the width 328. In the illustrative embodiment, the crown height 344 is 0.85 millimeters.

In another example, the crown height 344 is in a range of about or specifically 16 percent and about or specifically 20 percent of the width 328. In another example, the crown height 344 is about or specifically 18 percent of the width 328.

The pavilion 324 extends between and interconnects the girdle 322 and the culet 326 as shown in FIG. 14. The pavilion 324 includes a plurality of outer pavilion surfaces 346 that extend between and interconnect the girdle 322 and the culet 326. A pavilion angle 348 is defined between each outer pavilion surface 346 of the pavilion 324 and the bottom edge 336 of the girdle 322.

In one example, the pavilion angle 348 is in a range of about or specifically 36 degrees to about or specifically 50 degrees. In another example, the pavilion angle 348 is in a range of about or specifically 39 degrees to about or specifically 45 degrees. In another example, the pavilion angle 348 is in a range of about or specifically 40 degrees to about or specifically 45 degrees. In another example, the pavilion angle 348 is in a range of about or specifically 41 degrees to about or specifically 45 degrees. In another example, the pavilion angle 348 is in a range of about or specifically 42 degrees to about or specifically 45 degrees. In another example, the pavilion angle 348 is in a range of about or specifically 43 degrees to about or specifically 45 degrees.

In another example, the pavilion angle 348 is in a range of about or specifically 39 degrees to about or specifically 44 degrees. In another example, the pavilion angle 348 is in a range of about or specifically 39 degrees to about or specifically 43 degrees. In another example, the pavilion angle 348 is in a range of about or specifically 39 degrees to about or specifically 42 degrees. In another example, the pavilion angle 348 is in a range of about or specifically 39 degrees to about or specifically 40 degrees.

In another example, the pavilion angle 348 is in a range of about or specifically 36 degrees to about or specifically 45 degrees. In another example, the pavilion angle 348 is in a range of about or specifically 38 degrees to about or specifically 42 degrees. In another example, the pavilion angle 348 is in a range of about or specifically 39 degrees to about or specifically 41 degrees. In another example, the pavilion angle 348 is about or specifically 40 degrees. In the illustrative embodiment, the pavilion angle 348 is 40.4 degrees.

The pavilion 324 includes a pavilion depth 350 defined between the bottom edge 336 of the girdle 322 and the culet 326 as shown in FIG. 14. In one example, the pavilion depth 350 is in a range of about or specifically 37 percent and about or specifically 45 percent of the width 328 of the gemstone. In another example, the pavilion depth 350 is in a range of about or specifically 40 percent and about or specifically 44 percent of the width 328. In another example, the pavilion depth 350 is about or specifically 43 percent of the width 328. In the illustrative embodiment, the pavilion depth 350 is 42.9 percent of the width 328. In the illustrative embodiment, the pavilion depth 350 is 196 millimeters.

In another example, the pavilion depth 350 is in a range of about or specifically 38 percent and about or specifically 42 percent of the width 328 of the gemstone. In another example, the pavilion depth 350 is in a range of about or specifically 39 percent and about or specifically 41 percent of the width 328. In another example, the pavilion depth 350 is about or specifically 40 percent of the width 328.

The culet 326 is configured to mate with the light-emission system 314 as suggested in FIG. 2. The culet 326 is relatively oversized to increase a surface area engagement between the gemstone 312 and the light-emission system 314 for greater light absorption from the light-emission system 314 into the gemstone 312 as suggested in FIG. 13.

The culet 326 includes a culet width 352 (sometimes called culet diameter) as shown in FIG. 14. In one example, the culet width 352 is in a range of about or specifically 7.5 percent and about or specifically 20 percent of the width 328 of the gemstone 312. In another example, the culet width 352 is in a range of about or specifically 15 percent and about or specifically 19 percent of the width 328. In another example, the culet width 352 is in a range of about or specifically 16 percent and about or specifically 18 percent of the width 328. In another example, the culet width 352 is about or specifically 18 percent of the width 328. In the illustrative embodiment, the culet width 352 is about or specifically 17 percent of the width 328. In the illustrative embodiment, the culet width 352 is 0.78 millimeters.

In another example, the culet width 352 is in a range of about or specifically 18 percent and about or specifically 22 percent of the width 328. In another example, the culet width 352 is in a range of about or specifically 19 percent and about or specifically 21 percent of the width 328. In another example, the culet width 352 is about or specifically 20 percent of the width 328. The culet 326 may also be highly polished.

The gemstone 312 further includes a table 354 including a table width 356 as shown in FIGS. 12 and 14. In one example, the table width 356 is in a range of about or specifically 45 percent and about or specifically 65 percent of the width 328 of the gemstone 312. In another example, the table width 356 is in a range of about or specifically 51.5 percent and about or specifically 59 percent of the width 328. In another example, the table width 356 is in a range of about or specifically 54 percent and about or specifically 56.5 percent of the width 328. In another example, the table width 356 is about or specifically 55 percent of the width 328. In the illustrative embodiment, the table width 356 is 54.8 percent of the width 328. In the illustrative embodiment, the table width 356 is 2.50 millimeters.

In another example, the table width 356 is in a range of about or specifically 59 percent and about or specifically 63 percent of the width 328. In another example, the table width 356 is in a range of about or specifically 61 percent and about or specifically 62 percent of the width 328. In another example, the table width 356 is about or specifically 61.5 percent of the width 328.

The light-emission system 314 emits light over a period of time to illuminate the gemstone 312 as suggested in FIG. 11. In one example, the light-emission system 314 may emit a green light. In another example, the light-emission system 314 may emit a blue light. In still yet another example, the light-emission system 314 may emit any other suitable color of light. In other embodiments, the light-emission system 314 emits a plurality of colors of light.

The light-emission system 314 includes a light-emitting band 380 and a light-emitting disk 382 as shown in FIG. 11. The light-emitting band 380 and the light-emitting disk 382 emit visible light through the gemstone 312 to illuminate the gemstone 312 in response to receiving and storing energy 72 (e.g., U V light or ambient light). As such, the gemstone 312 is illuminated in dark environments by the light-emission system 314 until the stored energy 72 is depleted.

The light-emitting band 380 includes an upper portion that extends about the girdle 322 of the gemstone 312 as suggested in FIG. 11. In the illustrative embodiment, the light-emitting band 380 includes a lower portion configured to extend around a portion of the pavilion 324. In the illustrative embodiment, the lower portion of the light-emitting band 380 extends away from the upper portion by a band angle and the band angle is about equal to the pavilion angle 348.

The illustrative light-emitting band 380 is pear-cut shaped to extend around the pear-cut gemstone 312. The light-emitting band 380 is formed to include a gemstone-receiver aperture 370 sized to receive the gemstone 312. The light-emitting band 380 is coupled to an exterior surface of the girdle 322. In the illustrative embodiment, the light-emitting band 280 is coupled to an exterior surface of the pavilion 324. Illustratively, the light-emitting band 380 is made from a photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting band 380 has a thickness of about 0.5 millimeters. In some embodiments, the light-emitting band 380 includes plastics material.

The light-emitting disk 382 illustratively forms a solid cylinder configured to mate with the culet 326 of the gemstone 312 as suggested in FIG. 11. The light-emitting disk 382 is configured to couple to an exterior surface of the culet 326. Illustratively, the light-emitting disk 382 is made from a photo-luminescent material. In one example, the photo-luminescent material includes phosphorous material and poly-vinyl chloride. In another example, the photo-luminescent material includes phosphorous material and an acrylic material. In another example, the photo-luminescent material may include a phosphorous material, poly-vinyl chloride, an acrylic material, mixtures thereof, or any other suitable alternative. In the illustrative embodiment, the light-emitting disk 382 has a thickness of about 0.5 millimeters. In some embodiments, the light-emitting disk 382 includes plastics material.

The head 316 is configured to couple the gemstone 312 and light-emission system 314 with the mount 18 as suggested in FIG. 11. The illustrative head 316 includes a gem retainer 374, a culet support 376, and a plurality of prongs 378. The gem retainer 374 mates with the girdle 322 of the gemstone 312 and the light-emitting band 380 to retain the light-emitting band 380 between the gemstone 312 and the head 316. The culet support 376 is located in spaced-apart relation to the gem retainer 374 and mates with the light-emitting disk 382 to retain the light-emitting disk 382 between the culet 326 of the gemstone 312 and the head 316. The prongs 378 extend between and interconnect the gem retainer 374 and the culet support 376.

Another light-emitting jewelry piece 410 in accordance with the present disclosure is shown in FIGS. 15-17. The light-emitting jewelry piece 410 includes a gemstone 412, a light-emission system 414, a head 416, and the mounting 18. The gemstone 412 is a piece of material used to make an adornment such as, for example, a mineral, metal, rock, plastic, glass, colored gemstone, whether precious or non-precious, natural diamond, and lab-created diamond. The light-emission system 414 is configured to couple to an external surface of the gemstone 412 and to provide means for emitting light over time to cause visible light to be emitted through the gemstone 412. The head 416 interconnects the gemstone 412 to the mounting 18. The mounting 18 secures the light-emitting jewelry piece 410 to a person or a personal adornment.

Illustratively, the gemstone 412 is a round cut diamond as shown in FIG. 15. The gemstone 412 includes a crown 420, a girdle 422, a pavilion 424, and a culet 426 as shown in FIG. 17. The crown 420 is located in spaced-apart relation above the pavilion 424 to locate the girdle 422 therebetween. The pavilion 424 is located between the girdle 422 and the culet 426. The girdle 422 is formed to include a channel 423 that extends into the girdle 422 and that opens away from the gemstone 412. The light-emission system 414 includes a light-emitting band 480 configured to extend around the girdle 422 and into the channel 423 formed in the girdle 422 as shown in FIG. 16.

The girdle 422 defines a width 428 of the gemstone 412 as shown in FIG. 17. The illustrative girdle 422 is highly polished. The girdle 422 includes a top edge 434 and a bottom edge 436 spaced apart from the top edge 434. In the illustrative embodiment, the bottom edge 436 is spaced apart from the top edge 434 by a generally consistent distance around the circumference of the gemstone 412 to define a girdle height 438 as shown in FIG. 17. The girdle 422 has the relatively large girdle height 438 to increase a surface area engagement between the gemstone 412 and the light-emission system 414.

In some embodiments, the bottom edge 436 is spaced apart from the top edge 434 by a first distance in primary portions of the girdle 422 and by a second distance in secondary portions of the girdle 422. Each primary portion is positioned circumferentially between a pair of secondary portions. The first distance is greater than the second distance.

The girdle 422 further includes an upper-outer surface 481, a lower-outer surface 484, an upper-inclined surface 486, and a lower-inclined surface 488 as shown in FIGS. 16 and 17. The upper-outer surface 481 extends from the crown 420 toward the pavilion 424 and defines the top edge 434. The upper-inclined surface 486 extends inward into the gemstone 412 from the upper-outer surface 481 and toward the pavilion 424. The lower-inclined surface 488 extends outward from the upper-inclined surface 486 toward the lower-inclined surface 488. The lower-inclined surface 488 extends from the lower-inclined surface 488 toward the pavilion 424. The upper-outer surface 481 and the lower-outer surface 484 are substantially perpendicular to the table 456 and the culet 426 in the illustrative embodiment.

The upper-inclined surface 486 and the lower-inclined surface 488 cooperate to define the channel 423 as shown in FIG. 17. The upper-inclined surface 486 and the lower-inclined surface 488 converge toward one another. The upper-inclined surface 486 and the lower-inclined surface 488 meet at an inner-girdle edge 425 to cause the channel 423 to be V-shaped. The upper-inclined surface 486 and the lower-inclined surface 488 define a channel angle. In the illustrative embodiment, the channel angle is about 90 degrees. In some embodiments, the channel angle is about 90 degrees or less. The upper-inclined surface 486 extends at an angle of about 45 degrees relative to horizontal. The lower-inclined surface 488 extends at an angle of about 45 degrees relative to horizontal.

The channel 423 extends into the gemstone 412 and is configured to receive a portion of the light-emission system 414 as shown in FIG. 16. The inner-girdle edge 425 is spaced apart from the top edge 434 and the bottom edge 435 of the girdle 422 by about 0.40 millimeters or less into the gemstone 412.

In one example, the girdle height 438 is in a range of about or specifically 2 percent and about or specifically 15 percent of the width 428. In another example, the girdle height 438 is in a range of about or specifically 4 percent and about or specifically 8 percent of the width 428. In another example, the girdle height 438 is in a range of about or specifically 4.5 percent and about or specifically 8.5 percent of the width 428. In another example, the girdle height 438 is in a range of about or specifically 5 percent and about or specifically 7 percent of the width 428. In another example, the girdle height 438 is in a range of about or specifically 5.5 percent and about or specifically 7.5 percent of the width 428. In another example, the girdle height 438 is about or specifically 6.5 percent of the width 428. In another example, the girdle height 438 is about or specifically 6 percent of the width 428. In another example, the girdle height 438 is about or specifically 5.5 percent of the width 428.

The crown 420 extends from the girdle 422 away from the pavilion 424 as shown in FIGS. 16 and 17. An outer crown surface 440 of the crown 420 and the top edge 434 of the girdle 422 define a crown angle 442. In one example, the crown angle 442 is in a range of about or specifically 36 degrees to about or specifically 50 degrees. In another example, the crown angle 442 is in a range of about or specifically 39 degrees to about or specifically 46 degrees. In another example, the crown angle 442 is in a range of about or specifically 39 degrees to about or specifically 45 degrees. In another example, the crown angle 442 is in a range of about or specifically 39 degrees to about or specifically 44 degrees. In another example, the crown angle 442 is in a range of about or specifically 40 degrees to about or specifically 46 degrees. In another example, the crown angle 442 is in a range of about or specifically 41 degrees to about or specifically 46 degrees. In another example, the crown angle 442 is in a range of about or specifically 44 degrees to about or specifically 46 degrees. In another example, the crown angle 442 is in a range of about or specifically 45 degrees to about or specifically 46 degrees.

The crown 420 includes a crown height 444 defined between a table 454 of the gemstone 412 and the top edge 434 of the girdle 422 as shown in FIG. 17. In one example, the crown height 444 is in a range of about or specifically 15 percent and about or specifically 20 percent of the width 428 of the gemstone 412. In another example, the crown height 444 is in a range of about or specifically 17 percent and about or specifically 19 percent of the width 428. In another example, the crown height 444 is about or specifically 19 percent of the width 428. In another example, the crown height 444 is in a range of about or specifically 16 percent and about or specifically 20 percent of the width 428. In another example, the crown height 444 is about or specifically 18 percent of the width 428.

The pavilion 424 extends between and interconnects the girdle 422 and the culet 426 as shown in FIG. 17. The pavilion 424 includes a plurality of outer pavilion surfaces 446 that extend between and interconnect the girdle 422 and the culet 426. A pavilion angle 448 is defined between each outer pavilion surface 446 of the pavilion 424 and the bottom edge 436 of the girdle 422.

In one example, the pavilion angle 448 is in a range of about or specifically 36 degrees to about or specifically 50 degrees. In another example, the pavilion angle 448 is in a range of about or specifically 39 degrees to about or specifically 45 degrees. In another example, the pavilion angle 448 is in a range of about or specifically 40 degrees to about or specifically 45 degrees. In another example, the pavilion angle 448 is in a range of about or specifically 41 degrees to about or specifically 45 degrees. In another example, the pavilion angle 448 is in a range of about or specifically 42 degrees to about or specifically 45 degrees. In another example, the pavilion angle 448 is in a range of about or specifically 43 degrees to about or specifically 45 degrees.

The pavilion 424 includes a pavilion depth 450 defined between the bottom edge 436 of the girdle 422 and the culet 426 as shown in FIG. 17. In one example, the pavilion depth 450 is in a range of about or specifically 37 percent and about or specifically 45 percent of the width 428 of the gemstone. In another example, the pavilion depth 450 is in a range of about or specifically 40 percent and about or specifically 44 percent of the width 428. In another example, the pavilion depth 450 is about or specifically 43 percent of the width 428.

The culet 426 is configured to mate with the light-emission system 414 as suggested in FIG. 16. The culet 426 is relatively oversized to increase a surface area engagement between the gemstone 412 and the light-emission system 414 for greater light absorption from the light-emission system 414 into the gemstone 412 in some embodiments.

The culet 426 includes a culet width 452 (sometimes called culet diameter) as shown in FIG. 17. In one example, the culet width 452 is in a range of about or specifically 7.5 percent and about or specifically 20 percent of the width 428 of the gemstone 412. In another example, the culet width 452 is in a range of about or specifically 15 percent and about or specifically 19 percent of the width 428. In another example, the culet width 452 is in a range of about or specifically 16 percent and about or specifically 18 percent of the width 428. In another example, the culet width 452 is about or specifically 18 percent of the width 428.

The light-emission system 414 emits light over a period of time to illuminate the gemstone 412. In one example, the light-emission system 414 may emit a green light. In another example, the light-emission system 414 may emit a blue light. In still yet another example, the light-emission system 414 may emit any other suitable color of light. In other embodiments, the light-emission system 414 emits a plurality of colors of light.

The light-emission system 414 includes a light-emitting band 480 and a light-emitting culet cover 482 as shown in FIG. 16. The light-emitting band 480 and the light-emitting culet cover 482 emit visible light through the gemstone 412 to illuminate the gemstone 412 in response to receiving and storing energy 72 (e.g., UV light or ambient light). As such, the gemstone 412 is illuminated in dark environments by the light-emission system 414 until the stored energy 72 is depleted.

The illustrative light-emitting band 480 is configured to extend around the girdle 422 of the gemstone 412 as suggested in FIG. 16. The light-emitting band 480 is formed to include a gemstone-receiver aperture 470 sized to receive the gemstone 412. The light-emitting band 480 is coupled to an exterior surface of the girdle 422 and extends into the channel 423 formed in the girdle 422. In the illustrative embodiment, a portion of the light-emitting band 480 is coupled to an exterior surface of the pavilion 424 and to an exterior surface of the crown 420.

The light-emitting band 480 includes an outer-facing surface 492 and an inner-facing surface 494 as shown in FIG. 16. The outer-facing surface 492 is coupled to an inner surface 475 of a gem retainer 474 included in the head 416. The inner-facing surface 494 of the light-emitting band 480 is coupled to the upper-inclined surface 486 and the lower-inclined surface 488 of the girdle 422.

The light-emitting culet cover 482 illustratively forms a solid cylinder configured to mate with the culet 426 of the gemstone 412 as suggested in FIG. 16. The light-emitting culet cover 482 includes a surface 483 configured to couple to an exterior surface 427 of the culet 426 and a surface 485 configured to couple to a top surface 479 of a pusher rod 477 included in the head 416. In the illustrative embodiment, the light-emitting culet cover 482 has a height of about one-sixteenth of an inch. The light-emitting culet cover 482 covers the culet 426 and, in some embodiments, extends wider than the culet 426.

The light-emitting band 480 and the culet cover 482 may be used with a gemstone 412 having a relatively high refractive index, such as, for example a refractive index of greater than about 2.0. For example, gemstones 412 with relatively high refractive indexes include diamond, cubic zirconium, and silicon carbide. When a gemstone 412 with a relatively low refractive index is used, the light-emitting system may include a light-emitting band and alternative light-emitting members while omitting the light-emitting culet cover 482.

Illustratively, the light-emitting band 480 and the light-emitting culet cover 482 are made from photo-luminescent material. In one example, the photo-luminescent material includes phosphorous material and poly-vinyl chloride. In another example, the photo-luminescent material includes phosphorous material and an acrylic material. In another example, the photo-luminescent material includes a phosphorous material, poly-vinyl chloride, an acrylic material, mixtures thereof, or any other suitable alternative. In some embodiments, the light-emitting band 480 and the culet cover 482 include plastics material. In some embodiments, the light-emitting band 480 and the light-emitting culet cover 482 are made from phosphorous material, a varnish, a hardener, and a pigment. The phosphorous material may be a light-emitting fluid that may be solidified when heated.

The head 416 is configured to couple the gemstone 412 and light-emission system 414 with the mount 18 as suggested in FIGS. 15 and 16. The illustrative head 416 includes a gem retainer 474, a pusher rod 477, and a plurality of prongs 478. The gem retainer 474 extends around and mates with the light-emitting band 480. The pusher rod 477 is located in spaced-apart relation to the culet 426 and mates with the light-emitting culet cover 482. The prongs 478 extend between and interconnect the gem retainer 474 and the pusher rod 477.

The gem retainer 474 includes the inner surface 475 as shown in FIGS. 15 and 16. The inner surface 475 is arranged around and faces the girdle 422. The outer-facing surface 492 of the light-emitting band 480 is coupled to the inner surface 475. Light-emitting fluid is applied to the inner surface 475, the upper-inclined surface 486, and the lower-inclined surface 488 and solidified to form the light-emitting band 480. The light-emitting fluid includes a phosphorous gel in the illustrative embodiment. In other embodiments, the light-emitting band 480 is formed and then coupled to the girdle 422 and/or the gem retainer 474. In some examples, the inner surface 475 of the gem retainer 474 is roughened before the light-emitting fluid is applied to the inner surface 475. For example, 60-80 grit sandpaper may be used to roughen the inner surface 475. In some embodiments, 70 grit sandpaper is used to roughen the inner surface 475.

The pusher rod 477 includes the top surface 479 as shown in FIGS. 15 and 16. The pusher rod 477 is located relative to the culet 426 of the gemstone 412 such that a gap is formed between the top surface 479 of the pusher rod 477 and the culet 426. Light-emitting fluid is applied to the top surface 479 and the surface 427 of the culet and solidified to form the light-emitting culet cover 482. In other embodiments, the light-emitting culet cover 482 is formed and then coupled to the culet 426 and/or the pusher rod 477. In some examples, the top surface 479 of the pusher rod 477 is roughened before the light-emitting fluid is applied to the top surface 479. For example, 60-80 grit sandpaper may be used to roughen the top surface 479. In some embodiments, 70 grit sandpaper is used to roughen the top surface 479.

Another light-emitting jewelry piece 510 in accordance with the present disclosure is shown in FIGS. 18 and 19. The light-emitting jewelry piece 510 includes the gemstone 412, a colored wrap 533, the light-emission system 414, the head 416, and the mounting 18. The colored wrap 533 is semi-transparent and is applied to an exterior surface of the pavilion 424 to couple the colored wrap 533 to the pavilion 424 as shown in FIG. 19. The colored wrap 533 is configured shrink and form to a contour of the pavilion 424 by heating the colored wrap 533. Heat is applied to the colored wrap 533 by a heat gun, oven, kiln, or any other suitable heat application device. In some embodiments, the colored wrap includes cellophane. The colored wrap 533 may be one or more of a plurality of colors.

Another light-emitting jewelry piece 610 in accordance with the present disclosure is shown in FIGS. 20-22. The light-emitting jewelry piece 610 includes a gemstone 612, a light-emission system 614, a head 616, and the mounting 18. The gemstone 612 is a piece of material used to make an adornment such as, for example, a mineral, metal, rock, plastic, glass, colored gemstone, whether precious or non-precious, natural diamond, and lab-created diamond. The light-emission system 614 is configured to be coupled to an external surface of the gemstone 612 and to provide means for emitting light over time to cause visible light to be emitted through the gemstone 612. The head 616 interconnects the gemstone 612 to the mounting 18. The mounting 18 secures the light-emitting jewelry piece 610 to a person or a personal adornment.

Illustratively, the gemstone 612 is a checkerboard cut diamond as shown in FIG. 20. The gemstone 612 includes a crown 620, a girdle 622, a pavilion 624, and a culet 626 as shown in FIG. 22. The crown 620 is located in spaced-apart relation above the pavilion 624 to locate the girdle 622 therebetween. The pavilion 624 is located between the girdle 622 and the culet 626. The girdle 622 is formed to include a channel 623 that extends into the girdle 622 and that opens away from the gemstone 612.

The light-emission system 614 includes a light-emitting band 680 and a light-emitting pavilion plate 690 as shown in FIG. 20. The light-emitting band 680 is configured to extend around the girdle 622 and into the channel 623 formed in the girdle 622. The light-emitting pavilion plate 690 is configured to extend around the pavilion 624 of the gemstone 612.

The girdle 622 of the gemstone 612 defines a width 628 of the gemstone 612 as shown in FIG. 22. The illustrative girdle 622 is highly polished. The girdle 622 includes a top edge 634 and a bottom edge 636 spaced apart from the top edge 634. In the illustrative embodiment, the bottom edge 636 is spaced apart from the top edge 634 by a generally consistent distance around the circumference of the gemstone 612 to define a girdle height 638. The girdle 622 has the relatively large girdle height 638 to increase a surface area engagement between the gemstone 612 and the light-emission system 614.

The girdle 622 further includes an upper-outer surface 681, a lower-outer surface 684, an upper-inclined surface 686, and a lower-inclined surface 688 as shown in FIG. 22. The upper-outer surface 681 extends from the crown 620 toward the pavilion 624 and defines the top edge 634 of the girdle 622. The upper-inclined surface 686 extends inward into the gemstone 612 from the upper-outer surface 682 and toward the pavilion 624. The lower-inclined surface 688 extends outward from the upper-inclined surface 686 toward the lower-inclined surface 688. The lower-inclined surface 688 extends from the lower-inclined surface 688 toward the pavilion 624. The upper-outer surface 681 and the lower-outer surface 684 are substantially perpendicular to the table 656 and the culet 626 in the illustrative embodiment.

The upper-inclined surface 686 and the lower-inclined surface 688 cooperate to define the channel 623 as shown in FIG. 22. The upper-inclined surface 686 and the lower-inclined surface 688 converge toward one another. The upper-inclined surface 686 and the lower-inclined surface 688 meet at an inner-girdle edge 625 to cause the channel 623 to be V-shaped. The upper-inclined surface 686 and the lower-inclined surface 688 define a channel angle. In the illustrative embodiment, the channel angle is about 90 degrees. In other embodiments, the channel angle is about 90 degrees or less. The upper-inclined surface 686 extends at an angle of about 45 degrees relative to horizontal. The lower-inclined surface 688 extends at an angle of about 45 degrees relative to horizontal.

The channel 623 extends into the gemstone 612 and is configured to receive a portion of the light-emission system 614 as shown in FIG. 21. The inner-girdle edge 625 is spaced apart from the top edge 634 and the bottom edge 635 of the girdle 622 by about 0.40 millimeters or less into the gemstone 612.

In one example, the girdle height 638 is in a range of about or specifically 2 percent and about or specifically 15 percent of the width 628. In another example, the girdle height 638 is in a range of about or specifically 4 percent and about or specifically 8 percent of the width 628. In another example, the girdle height 638 is in a range of about or specifically 4.5 percent and about or specifically 8.5 percent of the width 628. In another example, the girdle height 638 is in a range of about or specifically 5 percent and about or specifically 7 percent of the width 628. In another example, the girdle height 638 is in a range of about or specifically 5.5 percent and about or specifically 7.5 percent of the width 628. In another example, the girdle height 638 is about or specifically 6.5 percent of the width 628. In another example, the girdle height 638 is about or specifically 6 percent of the width 628. In another example, the girdle height 638 is about or specifically 5.5 percent of the width 628.

The crown 620 extends from the girdle 622 away from the pavilion 624 as shown in FIGS. 21 and 22. An outer crown surface 640 of the crown 620 and the top edge 634 of the girdle 622 define a crown angle 642. In one example, the crown angle 642 is in a range of about or specifically 36 degrees to about or specifically 50 degrees. In another example, the crown angle 642 is in a range of about or specifically 39 degrees to about or specifically 46 degrees. In another example, the crown angle 642 is in a range of about or specifically 39 degrees to about or specifically 45 degrees. In another example, the crown angle 642 is in a range of about or specifically 39 degrees to about or specifically 44 degrees. In another example, the crown angle 642 is in a range of about or specifically 40 degrees to about or specifically 46 degrees. In another example, the crown angle 642 is in a range of about or specifically 41 degrees to about or specifically 46 degrees. In another example, the crown angle 642 is in a range of about or specifically 44 degrees to about or specifically 46 degrees. In another example, the crown angle 642 is in a range of about or specifically 45 degrees to about or specifically 46 degrees.

The crown 620 includes a crown height 644 defined between a top of the gemstone 612 and the top edge 634 of the girdle 622 as shown in FIG. 22. In one example, the crown height 644 is in a range of about or specifically 15 percent and about or specifically 20 percent of the width 628 of the gemstone 612. In another example, the crown height 644 is in a range of about or specifically 17 percent and about or specifically 19 percent of the width 628. In another example, the crown height 644 is about or specifically 19 percent of the width 628. In another example, the crown height 644 is in a range of about or specifically 16 percent and about or specifically 20 percent of the width 628. In another example, the crown height 644 is about or specifically 18 percent of the width 628.

The pavilion 624 extends between and interconnects the girdle 622 and the culet 626 as shown in FIGS. 21 and 22. The pavilion 624 includes a plurality of outer pavilion surfaces 646 that extend between and interconnect the girdle 622 and the culet 626. A pavilion angle 648 is defined between each outer pavilion surface 646 of the pavilion 624 and the bottom edge 636 of the girdle 622.

In one example, the pavilion angle 648 is in a range of about or specifically 36 degrees to about or specifically 50 degrees. In another example, the pavilion angle 648 is in a range of about or specifically 39 degrees to about or specifically 45 degrees. In another example, the pavilion angle 648 is in a range of about or specifically 40 degrees to about or specifically 45 degrees. In another example, the pavilion angle 648 is in a range of about or specifically 41 degrees to about or specifically 45 degrees. In another example, the pavilion angle 648 is in a range of about or specifically 42 degrees to about or specifically 45 degrees. In another example, the pavilion angle 648 is in a range of about or specifically 43 degrees to about or specifically 45 degrees.

The pavilion 624 includes a pavilion depth 650 defined between the bottom edge 636 of the girdle 622 and the culet 626 as shown in FIG. 22. In one example, the pavilion depth 650 is in a range of about or specifically 37 percent and about or specifically 45 percent of the width 628 of the gemstone. In another example, the pavilion depth 650 is in a range of about or specifically 40 percent and about or specifically 44 percent of the width 628. In another example, the pavilion depth 650 is about or specifically 43 percent of the width 628.

The culet 626 includes a culet width 652 (sometimes called culet diameter) as shown in FIG. 22. In one example, the culet width 652 is in a range of about or specifically 7.5 percent and about or specifically 20 percent of the width 628 of the gemstone 612. In another example, the culet width 652 is in a range of about or specifically 15 percent and about or specifically 19 percent of the width 628. In another example, the culet width 652 is in a range of about or specifically 16 percent and about or specifically 18 percent of the width 628. In another example, the culet width 652 is about or specifically 18 percent of the width 628.

The light-emission system 614 emits light over a period of time to illuminate the gemstone 612. In one example, the light-emission system 614 may emit a green light. In another example, the light-emission system 614 may emit a blue light. In still yet another example, the light-emission system 614 may emit any other suitable color of light. In other embodiments, the light-emission system 614 emits a plurality of colors of light.

The light-emission system 614 includes the light-emitting band 680 and the light-emitting pavilion plate 490 as shown in FIGS. 20 and 21. The light-emitting band 680 and the light-emitting pavilion plate 490 emit visible light through the gemstone 612 to illuminate the gemstone 612 in response to receiving and storing energy 72 (e.g., UV light or ambient light). As such, the gemstone 612 is illuminated in dark environments by the light-emission system 614 until the stored energy 72 is depleted. The light-emitting band 680 and the light-emitting pavilion plate 690 may be used with a gemstone 612 having a relatively low refractive index, such as, for example a refractive index of less than about 2.0.

The illustrative light-emitting band 680 is configured to extend around the girdle 622 of the gemstone 612 as suggested in FIG. 21. The light-emitting band 680 is formed to include a gemstone-receiver aperture 670 sized to receive the gemstone 612. The light-emitting band 680 is coupled to an exterior surface of the girdle 622 and extends into the channel 623 formed in the girdle 622. In the illustrative embodiment, a portion of the light-emitting band 680 is coupled to an exterior surface of the pavilion 624 and to an exterior surface of the crown 620.

The light-emitting band 680 includes an outer-facing surface 692 and an inner-facing surface 694 as shown in FIGS. 21 and 22. The outer-facing surface 692 is coupled to an inner surface 675 of a gem retainer 674 included in the head 616. The inner-facing surface 694 of the light-emitting band 680 is coupled to the upper-inclined surface 686 and the lower-inclined surface 688 of the girdle 622.

The light-emitting pavilion plate 690 is cone shaped and is arranged around the pavilion 624 as shown in FIG. 21. The pavilion plate 690 includes an outer layer 660 and an inner layer 662. The outer layer 660 is illustratively a metallic outer layer 660. The inner layer 662 includes light-emitting material and is coupled to the outer layer 660. The inner layer 662 is spaced apart from the pavilion 624 of the gemstone 612 in the illustrative embodiment to form a gap 664 therebetween as shown in FIG. 21. The gap 664 may reduce the visibility of the inner layer 662 in well-lit areas without impairing the light emitted through the gemstone 612 by the inner layer 662 in dusk or dark environments.

In other embodiments, the inner layer 662 is located adjacent an exterior surface of the pavilion. In some embodiments, the outer layer 660 of the pavilion plate 690 is omitted and the inner layer 662 is coupled to the pavilion 624. For example, the inner layer 662 may be coupled to the pavilion 624 and the outer layer 660 omitted in gemstones 612 of one-third carat or less.

Illustratively, the light-emitting band 680 and the inner layer 662 of the light-emitting pavilion plate 690 are made from photo-luminescent material. In one example, the photo-luminescent material includes phosphorous material and poly-vinyl chloride. In another example, the photo-luminescent material includes phosphorous material and an acrylic material. In another example, the photo-luminescent material includes a phosphorous material, poly-vinyl chloride, an acrylic material, mixtures thereof, or any other suitable alternative. In some embodiments, the light-emitting band 680 and the inner layer 662 of the light-emitting pavilion plate 690 include plastics material. In some embodiments, the light-emitting band 680 and the inner layer 662 of the light-emitting pavilion plate 690 are made from phosphorous material, a varnish, a hardener, and a pigment. The phosphorous material may be a light-emitting fluid that may be solidified when heated.

The head 616 is configured to couple the gemstone 612 and light-emission system 614 with the mount 18 as suggested in FIGS. 20 and 21. The illustrative head 616 includes a gem retainer 674 (sometimes called a girdle bezel or a bezel) and a plurality of prongs 678. The gem retainer 674 extends around and mates with the light-emitting band 680. The prongs 678 extend between and interconnect the gem retainer 674 and the mount 18.

The gem retainer 674 includes the inner surface 675 as shown in FIGS. 20 and 21. The inner surface 675 is arranged around and faces the girdle 622. The outer-facing surface 692 of the light-emitting band 680 is coupled to the inner surface 675. Light-emitting fluid is applied to the inner surface 675, the upper-inclined surface 686, and the lower-inclined surface 688 and solidified to form the light-emitting band 680. In other embodiments, the light-emitting band 680 is formed and then coupled to the girdle 622 and/or the gem retainer 674. In some examples, the inner surface 675 of the gem retainer 674 is roughened before the light-emitting fluid is applied to the inner surface 675. For example, 60-80 grit sandpaper may be used to roughen the inner surface 675. In some embodiments, 70 grit sandpaper is used to roughen the inner surface 675.

The pavilion plate 690 is coupled to the head 614 as shown in FIG. 21. Light-emitting fluid is applied to an inner surface of the outer layer 660 of the pavilion plate 690 to form the inner layer 662 of the pavilion plate 690. In other embodiments, the inner layer 662 is formed and then coupled to the outer layer 660. In some examples, the inner surface of the outer layer 660 is roughened before the light-emitting fluid is applied to the inner surface. For example, 60-80 grit sandpaper may be used to roughen the inner surface. In some embodiments, 70 grit sandpaper is used to roughen the inner surface of the outer layer 660 included in the pavilion plate 690.

Another embodiment of a head for use with a light-emitting jewelry piece in accordance with the present disclosure is shown in FIG. 21A. The head shown in FIG. 21A is substantially similar to the head 616 shown in FIG. 21 and includes a thin extruded bezel arranged around the light-emitting band 680. The thin bezel includes a shoulder that extends toward the crown 620 of the gemstone as shown in FIG. 21A. The prongs of the head are coupled to the thin bezel.

Methods 700, 800, 900 of making light-emitting jewelry pieces are shown in FIGS. 23, 24, and 25. Methods 700, 800, 900 include a number of steps and the methods may be combined and arranged in any order.

Method 700 of making light-emitting jewelry pieces includes a step 702 in which the gemstone 412, 612, the girdle bezel 474, 674 (gem retainer) included in the head 416, 616, and the light emitting fluid is provided as shown in FIG. 23. In a step 704, the inside surface 475, 675 of the girdle bezel 474, 674 of the head 416, 616 is roughened. In some embodiments, sandpaper is used to roughen the inside surface 475, 675. For example, 60-80 grit sandpaper may be used and, in some embodiments, 70 grit sandpaper is used.

The gemstone 412, 612 is set in the head 416, 616 in a step 706. The light-emitting fluid is applied to the inner surface 475, 675 of the girdle bezel 474, 674, the pavilion 424, 624, and the girdle 422, 622 in a step 708. The light-emitting fluid includes a phosphorous gel in the illustrative embodiment. In some embodiments, the gemstone 412, 612 is oriented so that the culet 426, 626 is pointed away from ground underlying the gemstone 412, 612 and a doser is used to apply the light-emitting fluid to the pavilion 424, 624 near the girdle 422, 622 so that the light-emitting fluid is gravity fed into the channel 423, 623 formed in the girdle 422, 622. In a step 710, the gemstone 412, 612, the girdle bezel 474, 674, and the light-emitting fluid are heated to solidify the light-emitting fluid. In some embodiments, the gemstone 412, 612, the girdle bezel 474, 674, and the light-emitting fluid are heated at about 170 degrees Fahrenheit for about three hours.

Method 800 of making light-emitting jewelry pieces includes a step 802 in which the gemstone 412 the pusher rod 477 of the head 416 and the light emitting fluid is provided as shown in FIG. 24. In a step 804, the top surface 479 of the pusher rod 477 is roughened. In some embodiments, sandpaper is used to roughen the top surface 479. For example, 60-80 grit sandpaper may be used and, in some embodiments, 70 grit sandpaper is used.

The pusher rod 477 is positioned in spaced apart relation from the culet 426 of the gemstone 412 in a step 806. In the illustrative embodiment, the pusher rod 477 is positioned in close proximity to the culet 426. In some embodiments, the top surface 479 is spaced apart from the surface 427 of the culet 426 by about one-sixteenth of an inch. The light-emitting fluid is applied to the top surface 479 of the pusher rod 477 and to the surface 427 of the culet 426 in a step 808. In some embodiments, the light-emitting fluid is suspended between the culet 426 and the top surface 479 of the pusher rod 477 before the fluid is solidified. The light-emitting fluid includes a phosphorous gel in the illustrative embodiment. In some embodiments, a doser is used to apply the light-emitting fluid. In a step 810, the gemstone 412, the pusher rod 477, and the light-emitting fluid are heated to solidify the light-emitting fluid. In some embodiments, the gemstone 412, the pusher rod 477, and the light-emitting fluid are heated at about 170 degrees Fahrenheit for about three hours.

Method 900 of making light-emitting jewelry pieces includes a step 902 in which the gemstone 612, the outer layer 660 of the pavilion plate 690, and the light emitting fluid is provided as shown in FIG. 25. In a step 904, the inner surface of the outer layer 660 is roughened. In some embodiments, sandpaper is used to roughen the inner surface. For example, 60-80 grit sandpaper may be used and, in some embodiments, 70 grit sandpaper is used.

The light-emitting fluid is applied to the inner surface of the outer layer 660 of the pavilion plate 690 in a step 906. The light-emitting fluid includes a phosphorous gel in the illustrative embodiment. In some embodiments, a doser is used to apply the light-emitting fluid. In a step 908, the outer layer 660 of the pavilion plate 690 and the light-emitting fluid are heated to solidify the light-emitting fluid and form the inner layer 662 of the pavilion plate 690. In some embodiments, the outer layer 660 of the pavilion plate 690 and the light-emitting fluid are heated at about 170 degrees Fahrenheit for about three hours. In a step 910 the pavilion plate 690 is coupled to the head 616 of the jewelry piece 610.

In one example, the gemstone may be a mineral, a crystal, metal, rock, plastic, glass, cubic zirconia, colored gemstone, whether precious or non-precious, natural diamond, lab-created diamond, combinations thereof, and/or any other suitable alternative. In one example where the gemstone has a refractive index which is different than diamond, the culet cover may be spaced apart from the culet of the gemstone. In this example, air may be located between the culet cover and the culet. One example of a gemstone where the culet cover is spaced apart from the culet is where the gemstone is a colored gemstone.

The following numbered clauses include embodiments that are contemplated and non-limiting:

Clause 1. A light-emitting jewelry piece comprising a gemstone including a crown, a girdle, a pavilion, and a culet, the crown located in spaced-apart relation above the pavilion to locate the girdle therebetween.

Clause 2. The light-emitting jewelry piece of clause 1, any other clause, or any combination of clauses, wherein the girdle is formed to include a channel that extends into the girdle and opens away from the gemstone, and the pavilion is located between the girdle and the culet.

Clause 3. The light-emitting jewelry piece of clause 2, any other clause, or any combination of clauses, further comprising a light-emission system including a light-emitting band coupled to an exterior surface of the gemstone.

Clause 4. The light-emitting jewelry piece of clause 3, any other clause, or any combination of clauses, wherein the light-emitting band is configured to emit light over time in response to receiving and storing light to cause visible light to be emitted through the gemstone.

Clause 5. The light-emitting jewelry piece of clause 4, any other clause, or any combination of clauses, wherein the light-emitting band extends around the girdle and into the channel formed in the girdle.

Clause 6. The light-emitting jewelry piece of clause 5, any other clause, or any combination of clauses, wherein the girdle includes an upper-inclined surface and a lower-inclined surface that cooperate to define the channel and the upper-inclined surface and the lower-inclined surface converge toward one another.

Clause 7. The light-emitting jewelry piece of clause 5, any other clause, or any combination of clauses, wherein the lower-inclined surface extends away from the upper-inclined surface by a channel angle and the channel angle is about 90 degrees or less.

Clause 8. The light-emitting jewelry piece of clause 5, any other clause, or any combination of clauses, wherein a top edge of the girdle defines a maximum width of the gemstone, the upper-inclined surface and the lower-inclined surface meet at an inner-girdle edge, and the inner-girdle edge is spaced apart from the top edge of the girdle by about 0.40 millimeters or less.

Clause 9. The light-emitting jewelry piece of clause 5, any other clause, or any combination of clauses, wherein the girdle further includes an upper-outer surface and a lower-outer surface, the upper-outer surface extends between the crown and the upper-inclined surface, and the lower-outer surface extends between the pavilion and the lower-inclined surface.

Clause 10. The light-emitting jewelry piece of clause 5, any other clause, or any combination of clauses, further including a head adapted to interconnect the gemstone with a mounting, the head includes a gem retainer that is arranged around the girdle, a plurality of prongs coupled to the gem retainer, and a pusher rod located in spaced apart relation relative to the culet of the gemstone, and the light-emitting jewelry piece further includes a light-emitting culet cover coupled to an exterior surface of the culet and coupled to an exterior surface of the pusher rod.

Clause 11. The light-emitting jewelry piece of clause 10, any other clause, or any combination of clauses, wherein the light-emitting band is adhered to the gem retainer.

Clause 12. The light-emitting jewelry piece of clause 10, any other clause, or any combination of clauses, further comprising a colored wrap coupled to an exterior surface of the pavilion.

Clause 13. The light-emitting jewelry piece of clause 5, any other clause, or any combination of clauses, wherein the gemstone has a refractive index of greater than about 2.0.

Clause 14. The light-emitting jewelry piece of clause 4, any other clause, or any combination of clauses, wherein the light-emission system further includes a cone-shaped pavilion plate that is arranged around a portion of the pavilion of the gemstone and the cone-shaped pavilion plate includes a metallic outer layer and a photo-luminescent inner layer located between the pavilion of the gemstone and the metallic outer layer.

Clause 15. The light-emitting jewelry piece of clause 14, any other clause, or any combination of clauses, wherein the photo-luminescent inner layer is spaced apart from the pavilion of the gemstone.

Clause 16. The light-emitting jewelry piece of clause 14, any other clause, or any combination of clauses, wherein the gemstone has a refractive index of less than about 2.0.

Clause 17. A method of making a light-emitting jewelry piece, the method comprising providing a gemstone, a head adapted to couple the gemstone to a mounting, and a light-emitting fluid, the gemstone including a crown, a girdle, a pavilion, and a culet, the crown located in spaced-apart relation above the pavilion to locate the girdle therebetween, and the head including a girdle bezel adapted to extend around the girdle.

Clause 18. The method of clause 17, any other clause, or combination of clauses, wherein the girdle is formed to define a channel that extends into the gemstone and opens away from the gemstone and the pavilion located between the girdle and the culet.

Clause 19. The method of clause 18, any other clause, or combination of clauses, further comprising roughing an inner surface of the girdle bezel.

Clause 20. The method of clause 19, any other clause, or combination of clauses, further comprising arranging the girdle bezel around the girdle of the gemstone so that the inner surface of the girdle bezel is aligned with and faces the girdle.

Clause 21. The method of clause 20, any other clause, or combination of clauses, further comprising applying the light-emitting fluid to the inner surface of the girdle bezel and to an external surface of the girdle to cause the light-emitting fluid to be positioned in the channel defined by the girdle.

Clause 22. The method of clause 21, any other clause, or combination of clauses, further comprising heating the gemstone, girdle bezel, and light-emitting fluid to cause the light-emitting fluid to harden and couple to the inner surface of the girdle bezel and the external surface of the girdle to form a light-emitting jewelry piece.

Clause 23. The method of clause 22, any other clause, or combination of clauses, wherein the head includes a pusher rod and the girdle bezel including the inner surface and the method further comprises positioning the pusher rod in spaced apart relation to the culet of the gemstone to cause an top surface of the pusher rod to face the culet and applying the light-emitting fluid to an external surface of the culet of the gemstone and to the top surface of the pusher rod.

Clause 24. The method of clause 23, any other clause, or combination of clauses, further comprising roughing the top surface of the pusher rod before applying the light-emitting fluid to the top surface of the pusher rod.

Clause 25. The method of clause 23, any other clause, or combination of clauses, further comprising applying a colored wrap around a portion of the pavilion.

Clause 26. The method of clause 22, any other clause, or combination of clauses, further comprising providing a pavilion plate adapted to be arranged around the pavilion of the gemstone so that an inner surface of the pavilion plate faces the pavilion of the gemstone and applying the light-emitting fluid to the inner surface of the pavilion plate.

Clause 27. The method of clause 26, any other clause, or combination of clauses, further comprising roughing the inner surface of the pavilion plate before applying the light-emitting fluid to the inner surface of the pavilion plate.

Clause 28. The method of clause 26, any other clause, or combination of clauses, further comprising coupling the pavilion plate the head such that the pavilion plate is spaced apart from the pavilion of the gemstone.

Clause 29. The method of clause 22, any other clause, or combination of clauses, wherein the girdle includes an upper-inclined surface and a lower-inclined surface that cooperate to define the channel and the upper-inclined surface and the lower-inclined surface converge toward each other.

Clause 30. The light-emitting jewelry piece of any other clause or combination of clauses, wherein the lower-inclined surface extends away from the upper-inclined surface by a channel angle and the channel angle is about 90 degrees or less.

Clause 31. The light-emitting jewelry piece of any other clause or combination of clauses, wherein the gemstone has a refractive index of greater than about 2.0.

Clause 32. The light-emitting jewelry piece of any other clause or combination of clauses, wherein the light-emission system further includes a cone-shaped pavilion plate that is arranged around a portion of the pavilion of the gemstone and the cone-shaped pavilion plate includes a metallic outer layer and a photo-luminescent inner layer located between the pavilion of the gemstone and the metallic outer layer.

Clause 33. The light-emitting jewelry piece of any other clause or combination of clauses, wherein the photo-luminescent inner layer is spaced apart from the pavilion of the gemstone.

Clause 34. The light-emitting jewelry piece of any other clause or combination of clauses, wherein the gemstone has a refractive index of less than about 2.0.

Clause 34. A method of making a light-emitting jewelry piece, the method comprising providing a gemstone, a head adapted to couple the gemstone to a mounting, and a light-emitting fluid, the gemstone including a crown, a girdle, a pavilion, and a culet, the crown located in spaced-apart relation above the pavilion to locate the girdle therebetween Clause 35. The method of any other clause or combination of clauses, wherein the girdle formed to define a channel that extends into the gemstone and opens away from the gemstone, the pavilion is located between the girdle and the culet, and the head includes a girdle bezel adapted to extend around the girdle.

Clause 36. The method of any other clause or combination of clauses, further comprising roughing an inner surface of the girdle bezel.

Clause 37. The method of any other clause or combination of clauses, further comprising arranging the girdle bezel around the girdle of the gemstone so that the inner surface of the girdle bezel is aligned with and faces the girdle.

Clause 38. The method of any other clause or combination of clauses, further comprising applying the light-emitting fluid to the inner surface of the girdle bezel and to an external surface of the girdle to cause the light-emitting fluid to be positioned in the channel defined by the girdle.

Clause 39. The method of any other clause or combination of clauses, further comprising heating the gemstone, girdle bezel, and light-emitting fluid to cause the light-emitting fluid to harden and couple to the inner surface of the girdle bezel and the external surface of the girdle to form a light-emitting jewelry piece.

Clause 40. The method of any other clause or combination of clauses, wherein the head includes a pusher rod and the girdle bezel including the inner surface and the method further comprises positioning the pusher rod in spaced apart relation to the culet of the gemstone to cause a top surface of the pusher rod to face the culet and applying the light-emitting fluid to an external surface of the culet of the gemstone and to the top surface of the pusher rod.

The invention claimed is:

1. A light-emitting jewelry piece comprising a gemstone including a crown, a girdle, a pavilion, and a culet, the crown located in spaced-apart relation above the pavilion to locate the girdle therebetween, the girdle formed to include a channel that extends into the girdle and that opens away from the gemstone, and the pavilion located between the girdle and the culet and a light-emission system including a light-emitting band coupled to an exterior surface of the gemstone and configured to emit light over time in response to receiving and storing light to cause visible light to be emitted through the gemstone, wherein the light-emitting band extends around the girdle and into the channel formed in the girdle.

2. The light-emitting jewelry piece of claim 1, wherein the girdle includes an upper-inclined surface and a lower-inclined surface that cooperate to define the channel and the upper-inclined surface and the lower-inclined surface converge toward one another.

3. The light-emitting jewelry piece of claim 2, wherein the lower-inclined surface extends away from the upper-inclined surface by a channel angle and the channel angle is about 90 degrees or less.

4. The light-emitting jewelry piece of claim 2, wherein a top edge of the girdle defines a maximum width of the gemstone, the upper-inclined surface and the lower-inclined surface meet at an inner-girdle edge, and the inner-girdle edge is spaced apart from the top edge of the girdle by about 0.40 millimeters or less.

5. The light-emitting jewelry piece of claim 2, wherein the girdle further includes an upper-outer surface and a lower-outer surface, the upper-outer surface extends between the crown and the upper-inclined surface, and the lower-outer surface extends between the pavilion and the lower-inclined surface.

6. The light-emitting jewelry piece of claim 1, further including a head adapted to interconnect the gemstone with a mounting, the head includes a gem retainer that is arranged around the girdle, a plurality of prongs coupled to the gem retainer, and a pusher rod located in spaced apart relation relative to the culet of the gemstone, and the light-emitting jewelry piece further includes a light-emitting culet cover coupled to an exterior surface of the culet and coupled to an exterior surface of the pusher rod.

7. The light-emitting jewelry piece of claim 6, wherein the light-emitting band is adhered to the gem retainer.

8. The light-emitting jewelry piece of claim 6, further comprising a colored wrap coupled to an exterior surface of the pavilion.

9. The light emitting jewelry piece of claim 6, wherein the gemstone has a refractive index of greater than about 2.0.

10. The light-emitting jewelry piece of claim 1, wherein the light-emission system further includes a cone-shaped pavilion plate that is arranged around a portion of the pavilion of the gemstone and the cone-shaped pavilion plate includes a metallic outer layer and a photo-luminescent inner layer located between the pavilion of the gemstone and the metallic outer layer.

11. The light emitting jewelry piece of claim 10, wherein the photo-luminescent inner layer is spaced apart from the pavilion of the gemstone.

12. The light emitting jewelry piece of claim 10, wherein the gemstone has a refractive index of less than about 2.0.

* * * * *